US011335985B2

(12) United States Patent
Pacaud et al.

(10) Patent No.: US 11,335,985 B2
(45) Date of Patent: May 17, 2022

(54) TUNABLE MICROWAVE SYSTEM

(71) Applicants: THALES, Courbevoie (FR); CENTRE NATIONAL DE LA RECHERCHE SCIENTIFIQUE, Paris (FR); CENTRE NATIONAL D'ETUDES SPATIALES, Paris (FR)

(72) Inventors: Damien Pacaud, Toulouse (FR); Etienne Laplanche, Limoges (FR); Serge Verdeyme, Limoges (FR); Olivier Tantot, Limoges (FR); Nicolas Delhote, Limoges (FR); Stéphane Bila, Limoges (FR); Aurélien Perigaud, Limoges (FR); Ludovic Carpentier, Toulouse (FR)

(73) Assignees: THALES, Courbevoie (FR); CENTRE NATIONAL DE LA RECHERCHE SCIENTIFIQUE, Paris (FR); CENTRE NATIONAL D'ETUDES SPATIALES, Paris (FR)

( * ) Notice: Subject to any disclaimer, the term of this patent is extended or adjusted under 35 U.S.C. 154(b) by 0 days.

(21) Appl. No.: 17/254,496

(22) PCT Filed: Jun. 17, 2019

(86) PCT No.: PCT/EP2019/065835
§ 371 (c)(1),
(2) Date: Dec. 21, 2020

(87) PCT Pub. No.: WO2019/243232
PCT Pub. Date: Dec. 26, 2019

(65) Prior Publication Data

US 2021/0167477 A1 Jun. 3, 2021

(30) Foreign Application Priority Data

Jun. 21, 2018 (FR) ..... 18/00641

(51) Int. Cl.
*H01P 1/165* (2006.01)
*H01P 1/17* (2006.01)
(Continued)

(52) U.S. Cl.
CPC ..... *H01P 1/219* (2013.01); *H01P 1/066* (2013.01); *H01P 1/122* (2013.01); *H01P 1/165* (2013.01)

(58) Field of Classification Search
CPC .. H01P 1/165; H01P 1/171; H01P 1/06; H01P 1/061; H01P 1/064; H01P 1/065; H01P 1/211; H01P 1/219
See application file for complete search history.

(56) References Cited

U.S. PATENT DOCUMENTS 2,634,332 A 4/1953 Zaleski
2,813,254 A 11/1957 Hatcher
(Continued)

OTHER PUBLICATIONS

Saleh, et al., "An Adjustable Quasi-Optical Bandpass Filter—Part 1: Theory and Design Formulas", IEEE Transactions on Microwave Theory and Techniques, vol. 22, Issue: 7, pp. 728-734, Jul. 1, 1974.

*Primary Examiner* — Dean O Takaoka
(74) *Attorney, Agent, or Firm* — BakerHostetler

(57) ABSTRACT

A tunable microwave system includes at least two elements, each element being chosen from a propagating guide, an evanescent guide, a resonator, and at least one coupling device arranged between the two elements and configured to couple the two elements to each other, the coupling device having a holder having an aperture and having at least one elongate element the shape of which is elongate in a polarization direction contained in a plane of the aperture, the elongate element being securely fastened to the perimeter of the aperture at at least one end, the coupling device being configured to be rotatable about an axis substantially perpendicular to the plane of the aperture so as to modify a
(Continued)

value of the polarization direction and so that the coupling between the two elements is dependent on the value of the polarization direction.

19 Claims, 24 Drawing Sheets

(51) Int. Cl.

| | |
|---|---|
| ***H01P 1/06*** | (2006.01) |
| ***H01P 1/211*** | (2006.01) |
| ***H01P 1/219*** | (2006.01) |
| ***H01P 1/12*** | (2006.01) |

(56) References Cited

U.S. PATENT DOCUMENTS

| | | | | |
|---|---|---|---|---|
| 3,634,788 | A | 1/1972 | Craven | |
| 8,917,149 | B2 * | 12/2014 | Blech | H01P 1/065 333/21 A |
| 2014/0028415 | A1 | 1/2014 | Perigaud et al. | |
| 2016/0322687 | A1 | 11/2016 | Weiss | |
| 2016/0351985 | A1 * | 12/2016 | Guglielmi | H01P 7/06 |
| 2019/0280357 | A1 * | 9/2019 | Hauff | H01P 1/17 |

* cited by examiner

| | S | 1 | 2 | 3 | 4 | 5 | 6 | L |
|---|---|---|---|---|---|---|---|---|
| S | 10.0000 GHz | 0.01002 | 0 | 0 | 0 | 0 | 0 | 0 |
| 1 | 0.01002 | 10.0000 GHz | -0.00843 | 0 | 0 | 0 | 0 | 0 |
| 2 | 0 | -0.00843 | 10.0000 GHz | 0.00611 | 0 | 0 | 0 | 0 |
| 3 | 0 | 0 | 0.00611 | 10.0000 GHz | 0.00583 | 0 | 0 | 0 |
| 4 | 0 | 0 | 0 | 0.00583 | 10.0000 Ghz | 0.00611 | 0 | 0 |
| 5 | 0 | 0 | 0 | 0 | 0.00511 | 10.0000 Ghz | 0.00843 | 0 |
| 6 | 0 | 0 | 0 | 0 | 0 | 0.00843 | 10.0000 Ghz | 0.01002 |
| L | 0 | 0 | 0 | 0 | 0 | 0 | 0.01002 | 10.0000 GHz |

FIG.20

| | S | 1 | 2 | 3 | 4 | 5 | 6 | L |
|---|---|---|---|---|---|---|---|---|
| S | 10.0000 GHz | 0.00995 | 0 | 0 | 0 | 0 | 0 | 0 |
| 1 | 0.00995 | 10.0000 GHz | -0.00829 | 0 | 0 | 0 | 0 | 0 |
| 2 | 0 | -0.00829 | 10.0000 GHz | -0.00576 | 0 | 0.00161 | 0 | 0 |
| 3 | 0 | 0 | -0.00576 | 10.0000 GHz | 0.00709 | 0 | 0 | 0 |
| 4 | 0 | 0 | 0 | 0.00709 | 10.0000 Ghz | 0.00576 | 0 | 0 |
| 5 | 0 | 0 | 0.00161 | 0 | 0.00576 | 10.0000 Ghz | 0.00829 | 0 |
| 6 | 0 | 0 | 0 | 0 | 0 | 0.00829 | 10.0000 Ghz | 0.00995 |
| L | 0 | 0 | 0 | 0 | 0 | 0 | 0.00995 | 10.0000 GHz |

FIG.24

| | S | 1 | 2 | 3 | 4 | L |
|---|---|---|---|---|---|---|
| S | 0 | 1.0352 | 0 | 0 | 0 | 0 |
| 1 | 1.0352 | 0 | 0.9106 | 0 | 0 | 0 |
| 2 | 0 | 0.9106 | 0 | 0.6999 | 0 | 0 |
| 3 | 0 | 0 | 0.6999 | 0 | 0.9106 | 0 |
| 4 | 0 | 0 | 0 | 0.9106 | 0 | 1.0352 |
| L | 0 | 0 | 0 | 0 | 1.0352 | 0 |

FIG.27

TUNABLE MICROWAVE SYSTEM

CROSS-REFERENCE TO RELATED APPLICATIONS

This application is a National Stage of International patent application PCT/EP2019/065835, filed on Jun. 17, 2019, which claims priority to foreign French patent application No. FR 1800641, filed on Jun. 21, 2018, the disclosures of which are incorporated by reference in their entirety.

FIELD OF THE INVENTION

The present invention relates to the field of systems operating in the microwave domain, and typically at frequencies comprised between 1 GHz and 30 GHz. More particularly, the present invention relates to systems the frequency and/or passband of which is tunable, or that perform switch or coupler type functions.

PRIOR ART

The processing of a microwave, for example one received by a satellite, requires specific components that allow this wave to propagate, be amplified, and be filtered, to be developed.

For example a microwave received by a satellite must be amplified before being sent back to ground. This amplification is possible only if all the frequencies received in channels that each correspond to a given frequency band are separated out. The amplification is then carried out channel by channel. The separation of the channels requires bandpass filters to be developed. Today, the frequency plan of a multiplexer or demultiplexer is set by design: the frequency and bandwidth of each channel are set from the very beginning.

The development of satellites and the increased complexity of the signal processing to be performed has created new needs with respect to these components, which must be made more flexible. For example, reconfiguration of channels in flight requires bandpass filters the frequency and, where appropriate, passband of which are tunable.

A bandpass filter allows a wave to propagate in a certain frequency range while attenuating this wave at other frequencies. A passband and a central frequency of the filter, called the tuning frequency, are thus defined. At frequencies around its central frequency, a bandpass filter has a high transmission coefficient and low reflection coefficient.

A bandpass filter comprises at least one resonator, the resonant mode of the filter corresponding to a particular distribution of the electromagnetic field excited at a particular frequency. Design of the filter is simplified if the resonators have circular or square symmetry.

Generally, depending on its geometry, a resonator has one or more resonant modes each characterized by a particular (distinctive) distribution of the electromagnetic field giving rise to a resonance of the microwave in the structure at a particular frequency. For example, TE or H (TE standing for transverse electric) or TM or E (TM standing for transverse magnetic) resonant modes having a certain number of energy maxima, which are labelled with indices, may be excited in the resonator at various frequencies. FIG. 1 illustrates, by way of example, the resonant frequencies of the various modes for an empty circular cavity as a function of the dimensions of the cavity (diameter D and height H).

Input and output exciting means of the filter allow the wave to be inserted into and extracted from the cavity, coupling the wave to the guides/lines upstream and downstream of the filter. These coupling means are for example apertures or slots, which are referred to as irises, coaxial or magnetic probes or microwave lines. Conventionally irises are of relatively simple shape: rectangular, circular or cruciform.

The passband of the filter is characterized in various ways depending on the nature of the filter. S-parameters (the letter S being taken from the expression "scattering matrix") are parameters that express the performance of the filter in terms of the reflection and transmission of energy as a function of frequency (under certain conditions such as a matched 50-ohm load). S11, or S22, corresponds to a measurement of reflection and S12, or S21, to a measurement of transmission. A characteristic example of the parameters S11 and S12 of a filter is illustrated in FIG. 2. Curve 11 corresponds to the coefficient S11 of reflection of the wave from the filter as a function of its frequency. By way of example, the equi-ripple 20 dB reflection passband has been denoted 26. The filter has a central frequency corresponding to the frequency of the middle of the passband. Curve 12 in FIG. 2 corresponds to the transmission coefficient S12 of the filter as a function of frequency. The filter thus allows a signal the frequency of which lies in the passband to pass, but the signal is nevertheless attenuated by the filter losses.

A filter may be made up of a number of resonators that are coupled to one another, each resonator having a resonant frequency, which to the first order is also called a pole. These frequencies are chosen to be close enough that the filter has an overall passband wider than that of a single resonator.

Conventionally, the resonators are coupled to each other by irises. The irises take the form of holes in the metal wall separating the two resonators. The shape of the iris determines the type of coupling (inductive, capacitive, or both) and the desired coupling level. For example a decrease in the height of the wall between the two guides results in capacitive coupling whereas a decrease in width results in inductive coupling. Coupling irises are conventionally rectangle, circular or cruciform in shape.

The coupling induced by these prior-art irises cannot be modified. If it were sought to modify it, one option could be to rotate the iris. However, rotating a rectangular iris, for example, allows the coupling to be modified in a limited and non-linear manner, and generates parasitic coupling that is detrimental to the maintenance of RF performance.

One example of a prior-art tunable filter is given in document US 2014/0028415. It comprises a number of resonators that are coupled together, each resonator comprising a rotatable dielectric element of a particular shape. Its general principle is to modify the electromagnetic field inside the filter using these dielectric disrupters, in order to shift the filter frequency-wise (modifications of the resonant frequencies). The dielectric elements are configured to all make the same rotation. Depending on the value of the angle of rotation, the properties of the filter are modified, via the values of the poles and therefore of the central frequency of the filter.

One aim of the present invention is to provide a new device for coupling two elements of a microwave system, this coupling device allowing coupling to be varied in a simple and versatile manner, with a view to producing a filter the frequency or passband of which is tunable, a switch, or a coupler.

DESCRIPTION OF THE INVENTION

The subject of the present invention is a tunable microwave system comprising at least two elements, each element being chosen from a propagating guide, an evanescent guide, a resonator, and at least one coupling device arranged between the two elements and configured to couple the two elements to each other.

The coupling device comprises a holder having an aperture and comprising at least one elongate element the shape of which is elongate in a direction called the polarization direction contained in a plane of the aperture, the elongate element being securely fastened to the perimeter of the aperture at at least one end.

The coupling device is configured to be rotatable about an axis substantially perpendicular to said plane of the aperture so as to modify a value of the polarization direction and so that the coupling between the two elements is dependent on said value of the polarization direction.

Preferably, the coupling device comprises a plurality of elongate elements parallel to one another. Preferably, the elongate elements form a grid (Gri) in the aperture. Preferably, the one or more elongate elements are wire, bar or strip shaped.

According to one embodiment, the aperture is circular or oval in shape.

Preferably, the one or more elongate elements are made of a metallized dielectric material or metal material, and are electrically connected to one another by a metal contact arranged on the perimeter of the aperture.

According to one embodiment, the holder takes the form of a circular disk configured to be rotated manually or using a micro stepper motor.

Preferably, which at least one portion of the holder is made of dielectric material.

According to one variant the preceding system comprises n successive resonators indexed i, i varying from 1 to n, n being higher than or equal to 2, the resonator indexed 1 being called the input resonator and the resonator indexed n being called the output resonator, and two successive resonators i and i+1 are coupled to each other by an associated coupling device, the system performing a tunable n-pole filter function.

According to one embodiment the system furthermore comprises an input coupling device configured to couple an input propagating guide to the input resonator and an output coupling device configured to couple the output resonator to an output propagating guide.

According to a second variant, the system comprises a resonator and a first evanescent guide arranged laterally with respect to said resonator with respect to a direction of propagation of a microwave through the system. The associated coupling device arranged between the resonator and the first evanescent guide is called the first lateral coupling device, and is configured to generate a variation in a resonant frequency of said resonator as a function of the polarization direction.

Preferably, the system furthermore comprises a second evanescent guide arranged on the side opposite to the first evanescent guide. The associated coupling device arranged between the resonator and the second evanescent guide is called the second lateral coupling device. The first and second lateral coupling devices are configured to have an identical polarization direction.

In combination, the system comprises n resonators indexed i, i varying from 1 to n, n being higher than or equal to 2, two successive resonators i and i+1 being coupled to each other by an associated coupling device, at least one resonator i also being coupled to a first evanescent guide by a first lateral coupling device and, where appropriate, to a second evanescent guide by a second lateral coupling device. The first and, where appropriate, the second evanescent guide are arranged laterally with respect to said resonator with respect to a direction of propagation of a microwave through the system.

According to one embodiment an input coupling device is configured to couple an input propagating guide to the input resonator and an output coupling device is configured to couple the output resonator to an output propagating guide.

According to one embodiment, the n resonators are configured so that a resonator i is furthermore coupled to a resonator j different from i+1 with an associated coupling device placed between the resonator i and the resonator j.

According to one option, the coupling device arranged between the resonator i and the resonator j is configured to create inter-resonator interference effects that allow transmission zeros to be added to the transmission of the tunable filter.

According to one embodiment, the coupling device between the resonator i and the resonator i+1 and the coupling device between the resonator j−1 and the resonator j are configured so that the coupling between said resonators drops each to zero for a set value of the polarization direction, so that the filter has a number of reconfigurable poles.

According to a third variant, the system comprises two contiguous propagating guides coupled to each other by an associated coupling device configured so that the coupling between said propagating guides drops to zero for a set value of the polarization direction.

According to one embodiment, the system comprises two propagating guides parallel to each other, the associated coupling device being arranged in a wall common to the two guides and being configured to achieve a transfer of a microwave propagating through one of the guides propagating to the other guide, said transfer being dependent on the value of the polarization direction.

BRIEF DESCRIPTION OF THE DRAWING

Other features, aims and advantages of the present invention will become apparent on reading the following detailed description with reference to the appended drawings, which are given by way of non-limiting example and in which:

FIG. 15 illustrates a system according to the invention in which the three variants are combined together.

FIG. 17 illustrates an example of the simulated performance of a 4-pole tunable filter as shown in FIG. 16.

FIG. 20 illustrates the corresponding coupling matrix.

FIG. 24 illustrates the corresponding coupling matrix.

FIG. 27 illustrates the coupling matrix corresponding to the system of FIG. 25.

DETAILED DESCRIPTION OF THE INVENTION

Figure 1:
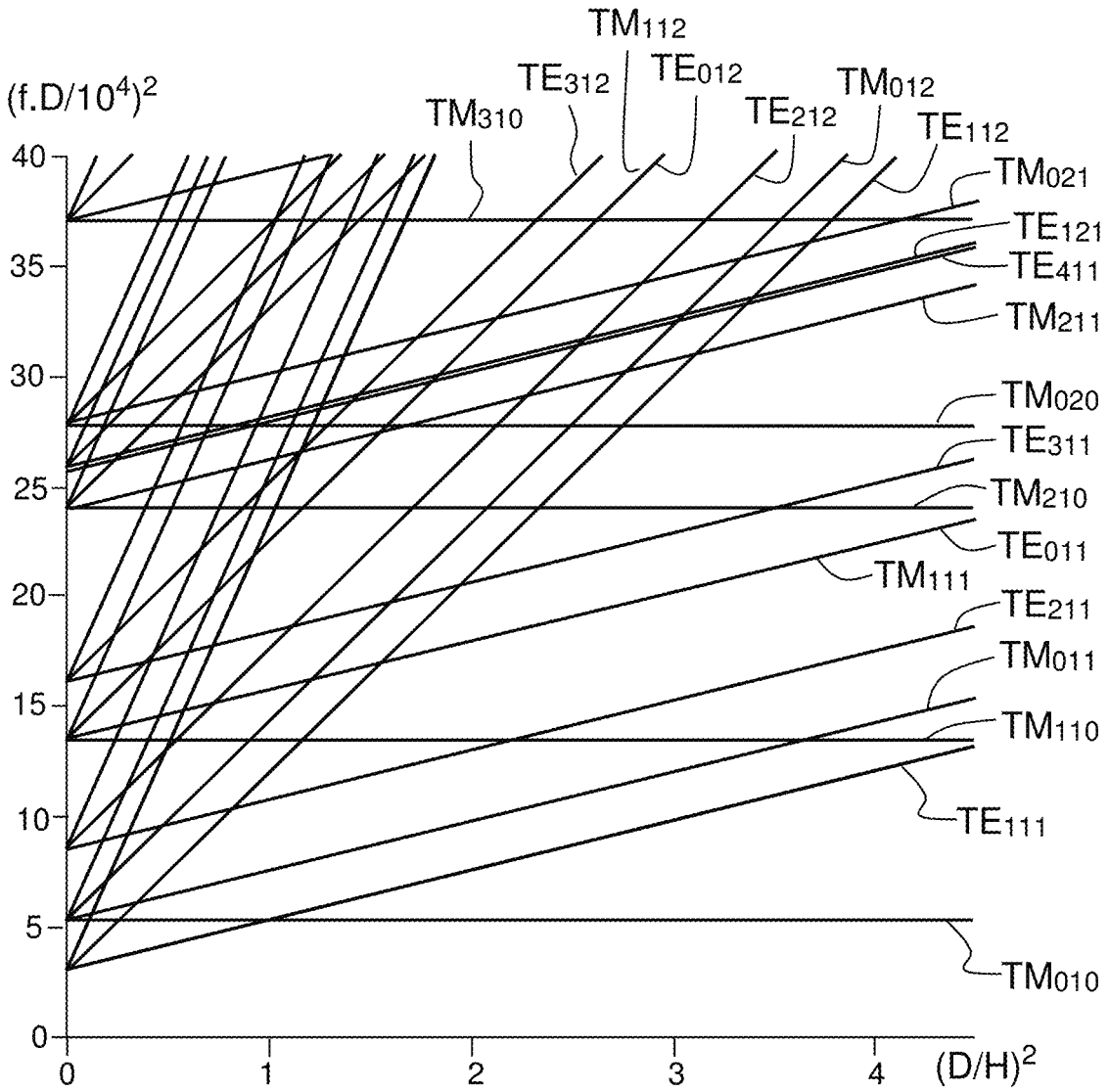
FIG. 1, to which reference has already been made, illustrates the resonant frequencies of the various modes of an empty circular cavity as a function of the dimensions of the cavity (diameter D and height H).
Figure 2:
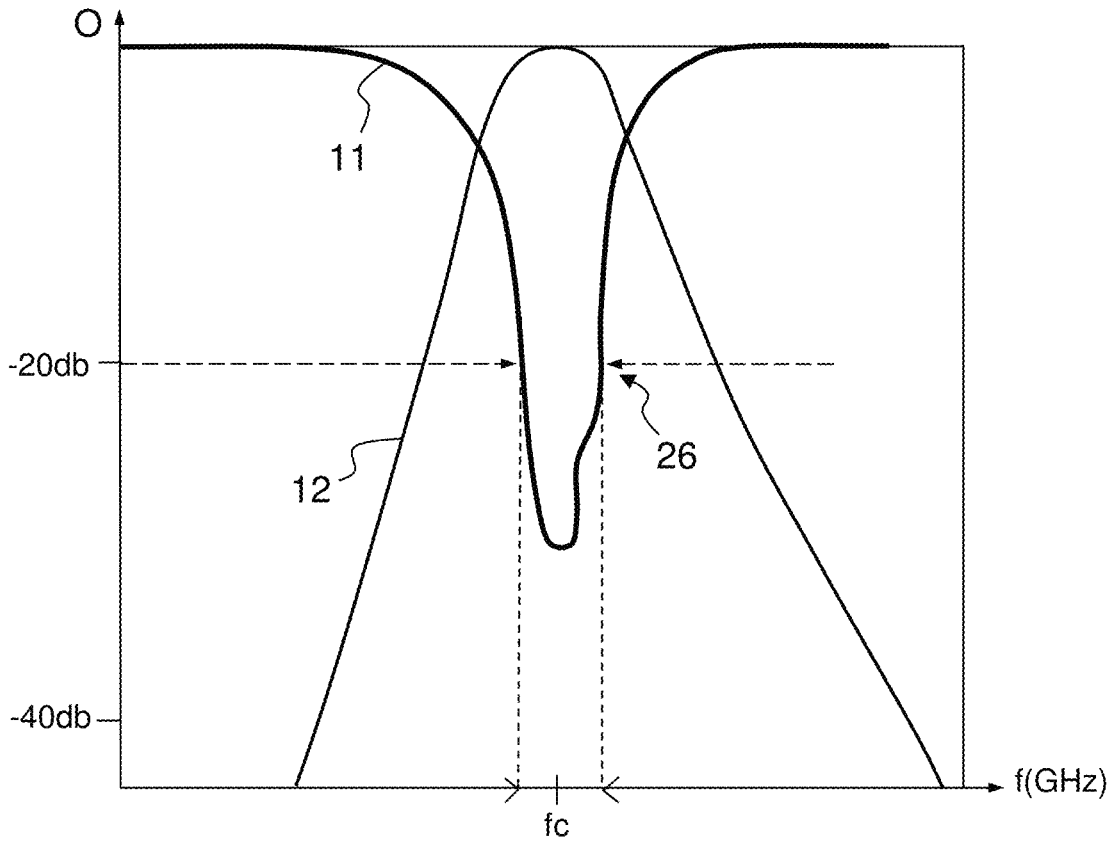
FIG. 2, to which reference has already been made, illustrates a characteristic example of the parameters S11 and S12 of a filter.
Figure 3:
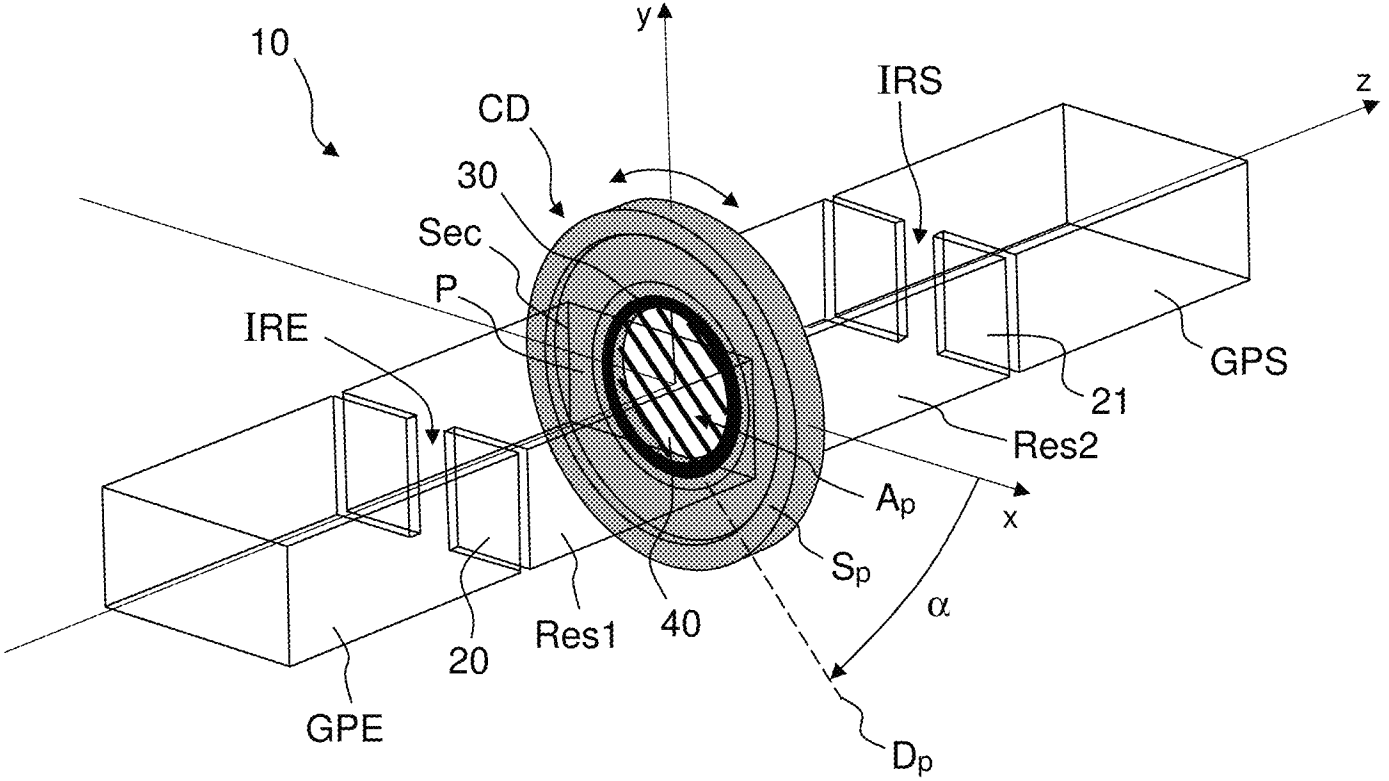
FIG. 3 illustrates a first variant of the tunable microwave system according to the invention.

The tunable microwave system 10 according to the invention is illustrated in FIG. 3 according to a first variant. The system 10 comprises at least two elements, each element being chosen from a (typically metal) propagating guide, an evanescent guide, a resonator and at least one coupling device CD arranged between the two elements and configured to couple the two elements to each other. FIG. 3 illustrates the first variant, in which the two elements are resonators Res1 and Res2. Other variants are described below.

By resonator, what is meant is a metal cavity of any shape, irrespectively of whether it is empty or contains a dielectric or metal element.

The coupling device CD according to the invention comprises a holder Sp having an aperture Ap and comprising at least one elongate element 40 the shape of which is elongate in a direction called the polarization direction Dp, Dp being contained in the plane P of the aperture Ap. In the example of FIG. 3, the direction Dp is substantially contained in the xy-plane perpendicular to z.

The elongate element 40 is securely fastened to the perimeter 30 of the aperture at at least one end.

The separating interface between the two elements defines a section Sec as shown in FIG. 3. The coupling device CD at least partially forms a separating wall between the two elements. According to one embodiment, the coupling device CD according to the invention, arranged in the section Sec, alone forms the separating wall. According to another embodiment, in the section Sec there is a metal separating wall on either side of an aperture, the device CD then being arranged against this wall. According to yet another embodiment, the device CD fits into the aperture of this wall (for example when the aperture of the walls is circular).

The coupling device is configured to be rotatable about an axis substantially perpendicular to the plane P of the aperture so as to modify the value of the polarization direction Dp, and is configured so that the coupling between the two elements is dependent on this value of the polarization direction. Thus, by rotating the device CD, the value of Dp is modified and therefore the coupling between the two elements is modified.

The direction Dp is identified by an angle α defined by convention with respect to the x-axis, corresponding to the horizontal in FIG. 3 (α=0 for a horizontal Dp). The coupling device CD performs the generic function of modifying the coupling between two elements, by simple rotation.

Conventionally, two elements chosen from the aforementioned elements are separated by an interface, typically a metal wall, which has an aperture perpendicular to the plane of the interface between the two elements, this aperture being referred to as an iris and allowing coupling between the two elements.

In the example of FIG. 3, an input propagating guide GPE is coupled to the first resonator Res1 by an input iris IRE consisting of a rectangular aperture in the separating wall 20, and the second resonator Res2 is coupled to an output propagating guide GPS by an output iris IRS, also consisting of a rectangular aperture in the separating wall 21.

The elongate element 40 modifies the boundary conditions of the electric field at the separating wall between the two elements, causing a deformation of the electric field, and therefore of the propagation conditions thereof. The coupling then corresponds to a transfer of energy from one element to the other.

In the case of a filter composed of two resonators, the filter has two resonant modes, and the coupling is defined by the proximity of the frequencies of these two modes, allowing energy to be exchanged.

The distribution of the electric field perpendicular to the direction of propagation is defined, for a given resonant mode, by 3 integers, this being the nomenclature of the mode. The two resonant modes of the filter are identical except for the distribution of the fields in the interface between the resonators. It is therefore the distribution of the fields in this interface that will modify the proximity of the frequencies of the two modes (or coupling). The device CD, by modifying this distribution, modifies the coupling between these modes without changing their nomenclature (or nature).

Let f1 be the resonant frequency of the first mode and f2 the resonant frequency of the second mode. Coupling these two resonators via the coupling device CD, which introduces a disruptive element into the system, modifies the value of a resonant frequency of one of the resonators (for example f1) whereas the other (f2) remains the same. The further the frequency f1 gets from f2, the stronger the coupling. Conversely, when f1 equals f2, the coupling may be considered to be zero.

Conventionally, the coupling coefficient M is defined as:

$$M=(f22-f12)/(f12+f22) \quad (1)$$

The device CD according to the invention allows the coupling, and therefore the frequency f1, and therefore the value of M, to be modified depending on the angle α.

Conventionally, there are two types of coupling, inductive coupling and capacitive coupling. To use a circuit analogy, inductive coupling (of form jLω) is given a "+" sign, and capacitive coupling (of form 1/jCω) a "−" sign.

According to this analogy, the coupling device according to the invention introduces a complex impedance seen by the electric field between the two elements.

A modification of the coupling in the context of the invention covers a variation in the amplitude of coupling of a given type, but also a change in the type of coupling, the device allowing, under certain conditions, to switch from inductive coupling to capacitive coupling or vice versa depending on a. A change in the nature of the coupling results in a change in the sign of M, i.e. a frequency f1 becoming higher than f2 (see below). The great versatility of the modification in coupling achieved via the device CD according to the invention makes a vast range of applications, particularly filters that have a tunable passband, central frequency, number of poles, etc., possible.

The value of the coupling coefficient M and its variation as a function of a, which characterize the coupling introduced by the device CD between the two elements Res1 and Res2, is dependent on the following parameters: size/shape/thickness of the aperture Ap, distribution/shape/material of the one or more elongate elements, material of the holder, etc.

Preferably, to achieve a greater amplitude of change in M, the coupling device according to the invention comprises a plurality of elongate elements 40 parallel to one another and securely fastened to the perimeter at both their ends. Preferably, and for the same reason, the one or more elongate elements form a grid Gri in the aperture Ap as illustrated in FIG. 3. If the grid extends right across the aperture, a coupling of zero, or switch effect, may be obtained (see below). The denser the grid, i.e. the higher the number of elongate elements 40, which will also be referred to as bars, the more pronounced the switch effect. However, the bars introduce losses, and a compromise has to be found between switch performance and system losses. Here, the coupling device CD may be considered to perform the function of polarizing the electric field at the aperture, and the device CD may thus be likened to a "polarizing iris".

To obtain a pronounced switch effect, it is preferable for the resonant modes used to be linearly polarized in the two cavities, whatever the type of mode TEmnp chosen.

In the case of a periodic grid the structure of which is symmetrical, the total excursion of the variation in M occurs for a between 0° and 90°.

When the grid only partially fills the aperture Ap (elongate elements securely fastened at one end only), because of the asymmetric structure of the grid, the total excursion of the variation in M occurs for a between 0° and 180°, or even 360°.

Preferably, the elongate elements 40 are wire, bar or strip shaped.

The elements 40 may be made of dielectric material, of metallized dielectric material or of metal material. The last two possibilities are preferred, for better effectiveness with respect to polarization of the electric field. In the case of metallized or metal bars 40, these are preferably electrically connected to one another by a metal contact arranged on the periphery of the aperture, i.e. on the perimeter 30, so that they share a common ground. Preferably for a grid Gri, a metal band covers the entire perimeter 30.

The aperture Ap may be any shape. It is not necessarily centered on the section Sec separating the two elements. In this case, because of the asymmetry, an excursion in α of 180° or 360° may be necessary to obtain the maximum variation in coupling.

In fact what counts is the modal distribution of the fields in the interface. For example, if the mode (TE201 for example) does not have a field maximum in the middle of the interface, but two maxima respectively at ¼ and ¾ of this interface, it is preferable to arrange the iris at ¼ of the cavity (or to provide two irises, one at each max). The coupling is weaker than with a TE101 mode, but the complete variation between 0 and 90° is nonetheless obtained anyway.

Preferably, for reasons of ease of design and to obtain a large range of variation in coupling, the aperture Ap is circular or oval in shape. Generally, the shape of the aperture is chosen depending on the desired coupling law.

For a centered grid, it is preferable for the resonant modes to be of TE10p type, because for this type of mode the field is maximal in the middle of the coupling interface. However, this is also the case for a TEnmp mode with n and m being odd or zero. Furthermore, the higher the order of the mode, the smaller the area of the maximum of this mode and therefore the weaker the coupling obtained will be.

Depending on the desired coupling, various configurations are possible as regards the relative dimensions of the aperture Ap and the section Sec.

In FIG. 3, the diameter of the aperture Ap is larger than the smaller dimension of the section Sec but smaller than the larger dimension.

The aperture may also be larger than the dimension of the section (circular section) or than both dimensions of the section (rectangular section). Furthermore, the aperture Ap may fit into the section Sec at all the angles α used, or at only some of them.

As regards the holder Sp, it may take any form.

Preferably, the holder Sp takes the form of a circular disk, this allowing it to be made easily rotatable. Preferably, the holder is configured to be rotated manually or using a micro stepper motor.

According to one embodiment, the holder is made of a metal material or of a metallized dielectric material.

Figure 4:
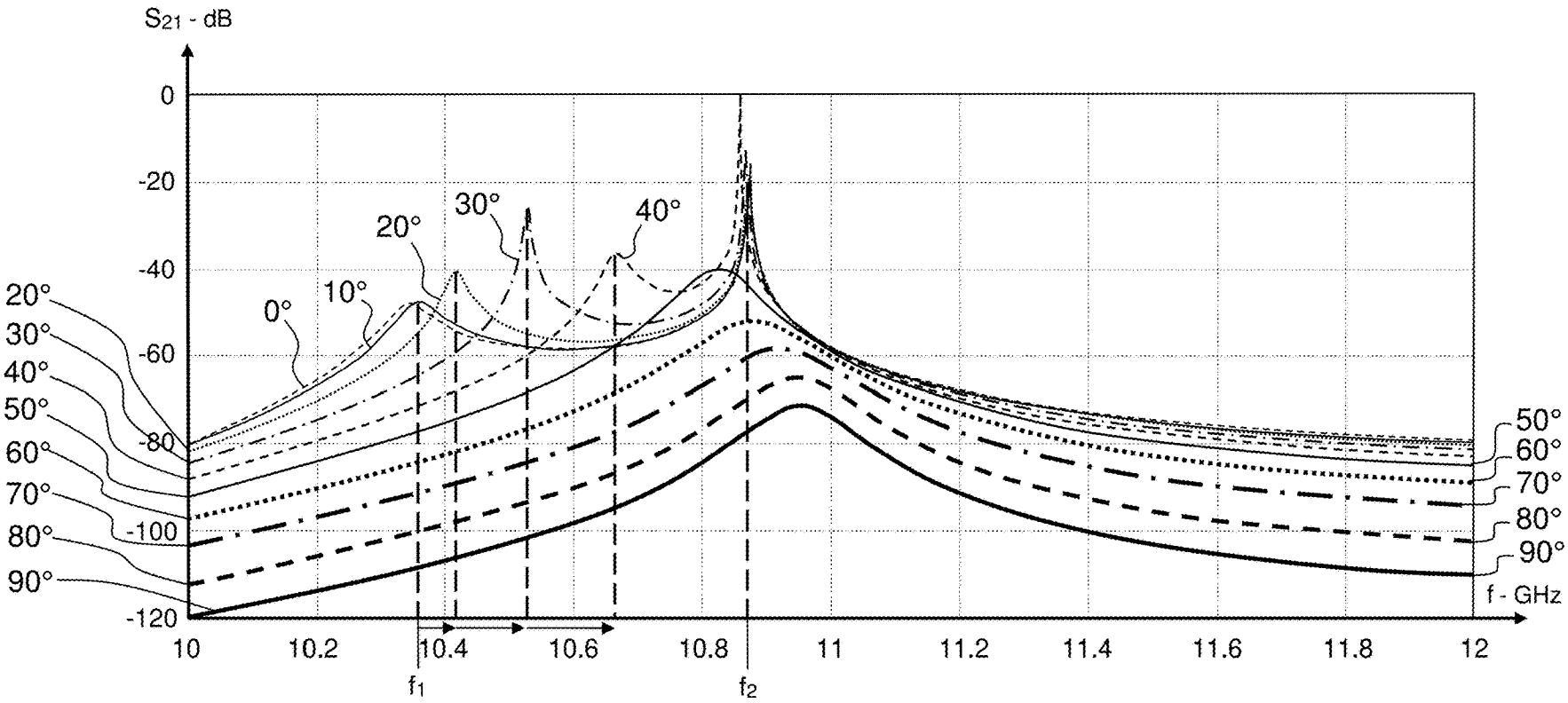
FIG. 4 illustrates various curves of the transmission coefficient S12 of a system consisting of two resonators coupled to each other by a coupling device consisting of a regular metal grid and of a metal holder (infinite electrical conductivity), as a function of the angle $\alpha$ of the polarization direction Dp.

By way of example, FIG. 4 illustrates various curves of the transmission coefficient S12 of a system consisting of two resonators coupled to each other by a device CD consisting of a regular metal grid and of a metal holder (infinite conductivity), as a function of the angle $\alpha$ of the polarization direction Dp.

The dimensions of the two metal cavities of the resonators are identical (height 9.5 mm, width 19 mm and length 19 mm). The circular aperture Ap has a diameter of about 9.7 mm and a thickness of 1 mm. The bars are rectangular, of 0.5×0.5 mm cross-sectional area, and spaced apart by 2 mm.

It may be seen that, up to 40°, there are two resonant frequencies, the frequency f2 remaining constant while the frequency f1 approaches f2 as a increases. From 50° there is only a single resonant frequency, which is slightly different from the initial frequency f2. From $\alpha$=50° the coupling between the two resonators is zero.

Figure 5:
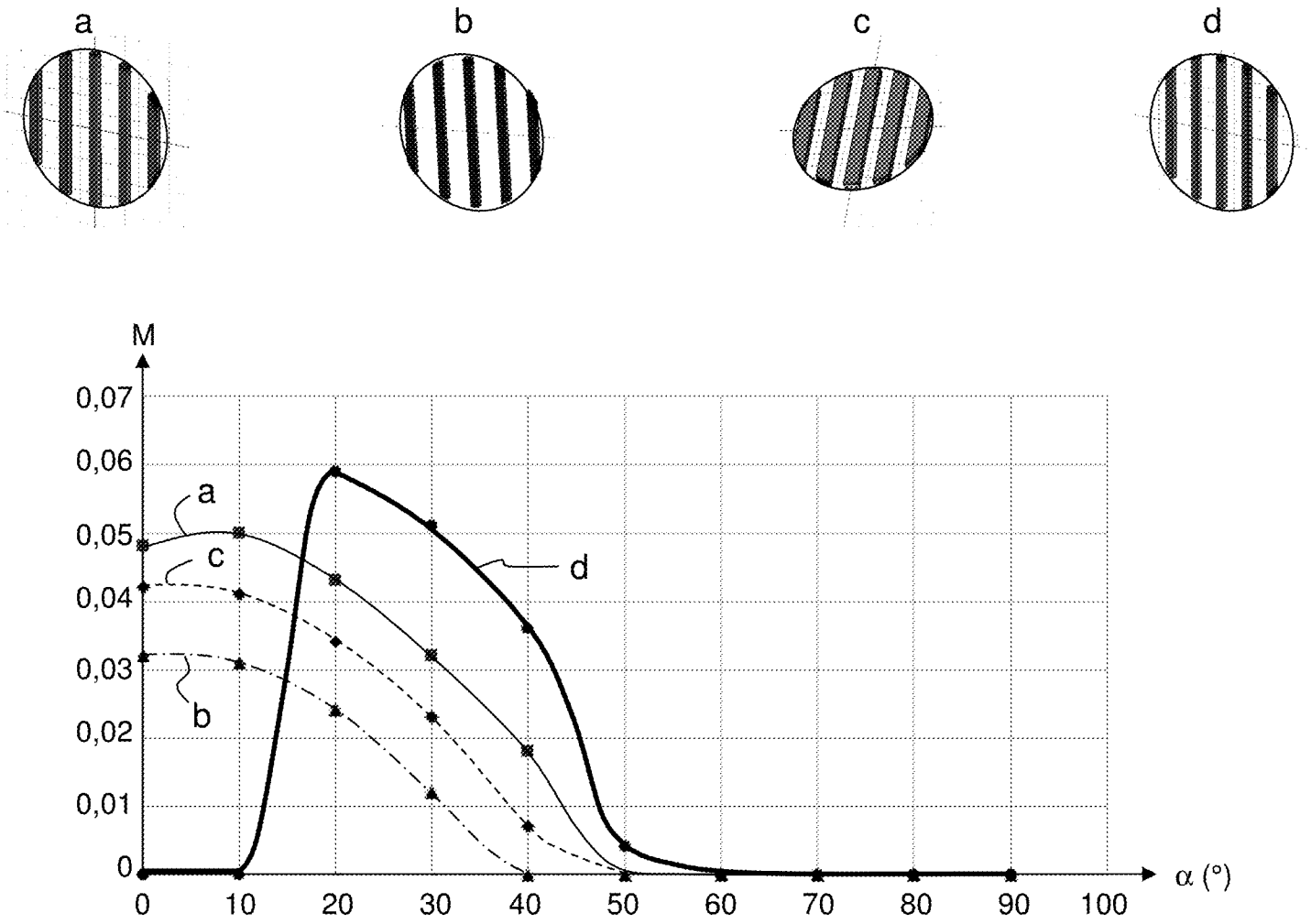
FIG. 5 illustrates the coupling coefficient M as a function of the angle $\alpha$ for various grid configurations.

FIG. 5 illustrates the coupling coefficient M computed with formula 1 as a function of a for various grid configurations. The previous case is case a (the coupling coefficient is indeed zero from 50°). Curve b corresponds to the case of a thinner (1 mm thick) iris, case c to thicker bars (rectangular section of 1 mm) and case d to an iris radius of 5 mm, with a grid identical to case a.

The variation in the value of M as a function of a depends on the parameters of the coupling device.

It is noted that the coupling coefficient M does not change sign, the type of coupling, here inductive, remaining unchanged. This is due to the purely metal character of the holder.

Thus, by choosing the various aforementioned parameters of the coupling device, it is possible to adjust the coupling continuously over a much larger range than would be achieved by rotation of a single iris. It is also possible to completely prevent coupling, the device CD then behaving like a short circuit. The two cavities are then disconnected from each other. An application of this switch functionality is described below.

Figure 6:
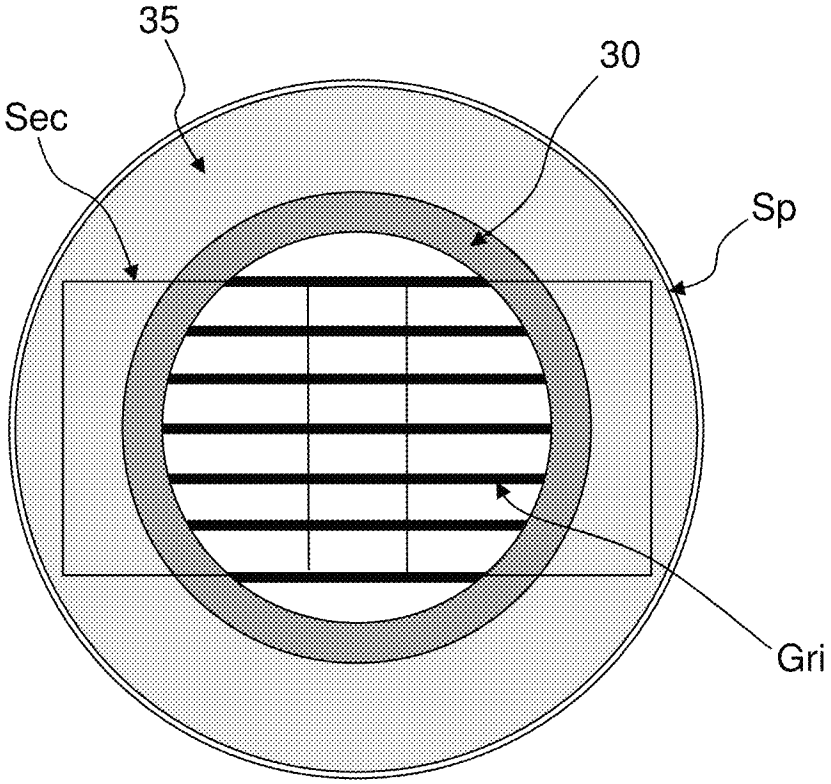
FIG. 6 illustrates one embodiment in which at least one portion of the holder is made of dielectric material.

According to one embodiment at least one portion of the holder is made of dielectric material, as illustrated in FIG. 6. This allows RF leakage to be prevented and makes it easier to rotate the holder. FIG. 6 illustrates a coupling device made up of a metal (or metallized) grid, and of a holder Sp comprising a metal portion on the perimeter 30 of the aperture, connecting the bars together, and a portion 35, on the periphery, made of dielectric material. Typically it is a question of a ceramic (alumina, zirconia, BMT) or of a plastic, or of fused silica.

In this case, the section Sec defining the separation between the two resonators comprises a fraction of the grid Gri, a fraction of the metal perimeter and a fraction of the portion 35 made of dielectric material.

Furthermore, the presence of a dielectric portion seen by the electric field creates a second path for the latter. Through this dielectric portion a second type of coupling is created which here, because of the circular shape of the holder Sp, is not modified by the rotation of the holder Sp. This second coupling, which is therefore constant (independent of $\alpha$), superposes on the coupling achieved through the grid. This coupling may be additive or subtractive depending on the shape and material of the dielectric portion 35 and on the resonant modes of the cavity. The effect of subtractive coupling is to shift the curve M($\alpha$) downward.

Apart from the change in the nature of the filter, the change of sign allows the filtering function to be modified, and for example transmission zeros to be added or removed.

According to another option, it is a portion of the wall between the two resonators that is made of dielectric material.

Figure 7:
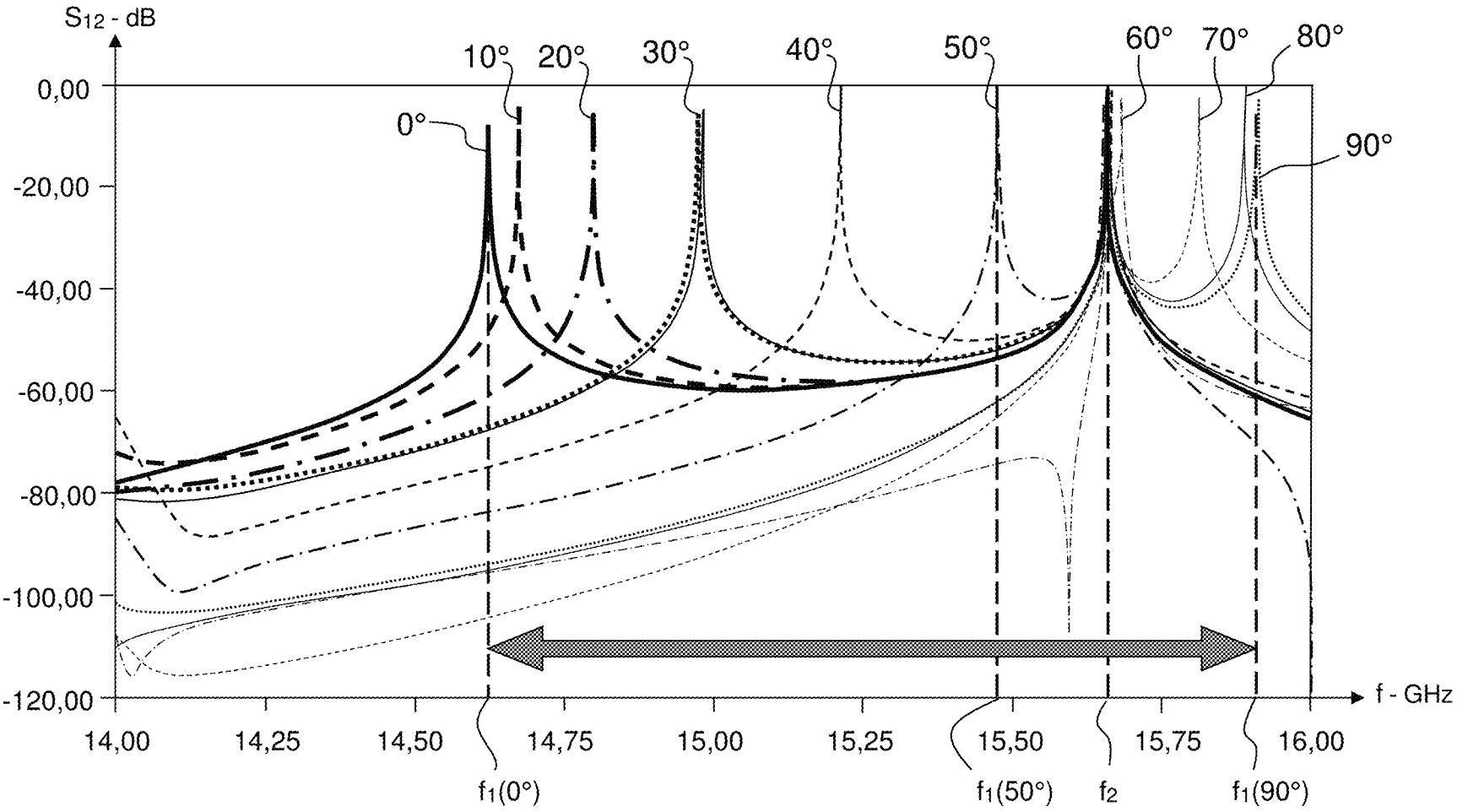
FIG. 7 illustrates the transmission coefficient S12 of the system according to the invention, as illustrated in FIG. 3, with a coupling device the holder of which comprises a dielectric portion, as illustrated in FIG. 6.

FIG. 7 illustrates the transmission coefficient S12 of the system 10 according to the invention, as illustrated in FIG. 3, with a coupling device the holder of which comprises a dielectric portion, as illustrated in FIG. 6.

Cavity of 24.27×19.05×9.52 mm.

Radius of the holder: 13.9 mm, radius of the aperture 6 mm, dielectric material of the holder of permittivity equal to 32.

Figure 8:
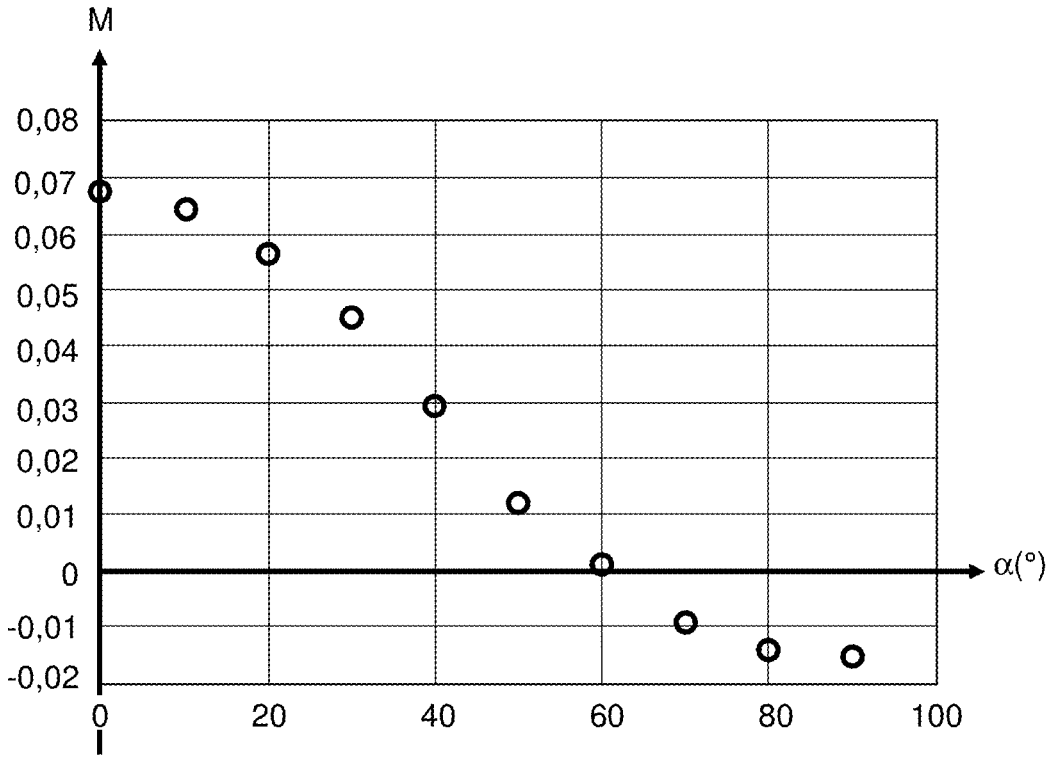
FIG. 8 illustrates the variation in the coupling coefficient M as a function of the a of the tunable filter the operation of which is illustrated in FIG. 7.

The curves are given for various values of $\alpha$ varying from 0° to 90°. The frequency f2 remains constant and is equal to 15.67 GHz. The frequency f1 varies (between 0° and 90°) between 14.65 GHz (0°) and 15.9 GHz (90°). It will be noted that the coupling decreases between 0° and 60°, value at which the coupling drops to zero (f1)(60°~f2), then the frequency f1 becomes higher than f2, this meaning that the sign of the coupling has changed from positive to negative. The variation in the corresponding coupling coefficient M therefore starts at a positive starting value Mmax for 0° and passes through 0 at 60° and becomes negative, as illustrated in FIG. 8, which shows the variation in the coupling coefficient M as a function of a for the tunable filter the operation of which is illustrated in FIG. 7.

Figure 9:
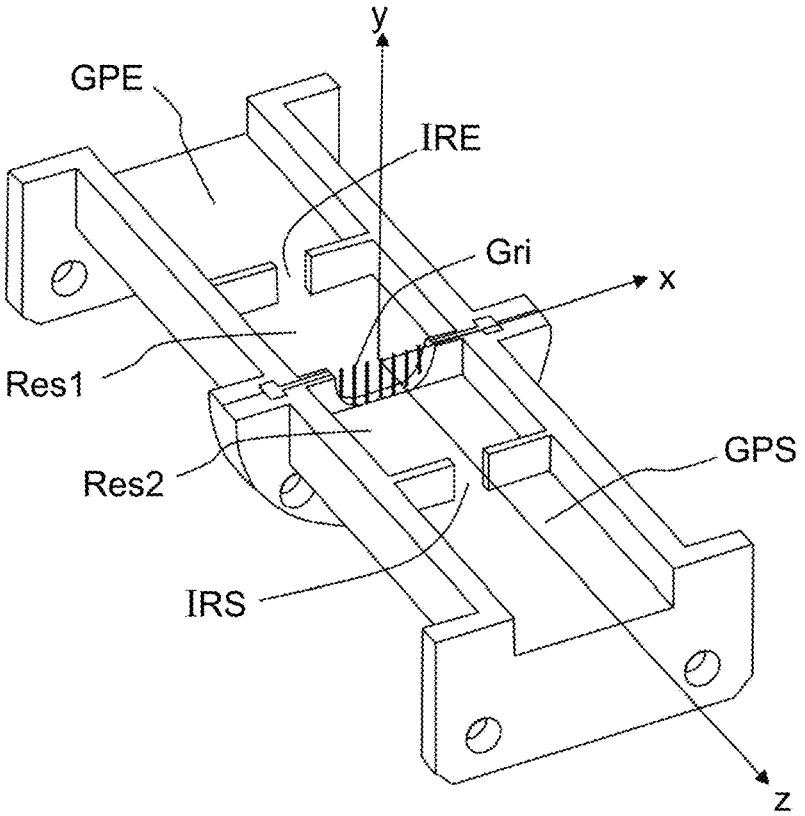
FIG. 9 illustrates a cross-sectional view of a practical embodiment of a system as illustrated in FIG. 3 with a coupling device as illustrated in FIG. 6.
Figure 10:
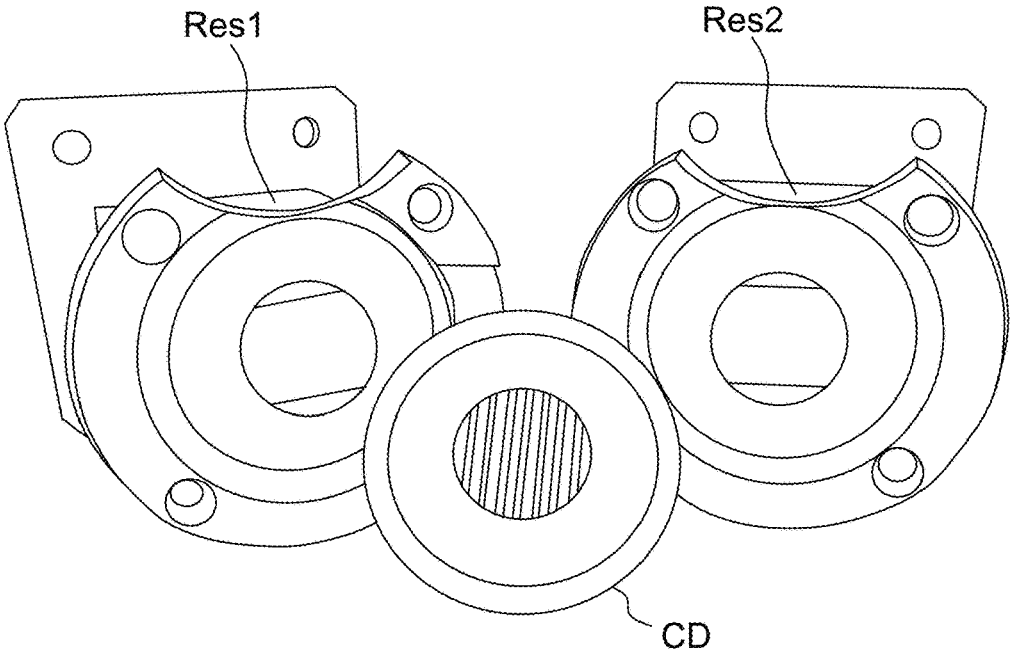
FIG. 10 is a photograph of the various constituent elements of the system of FIG. 9.

A cross-sectional view of a practical embodiment of a system as illustrated in FIG. 3 with a coupling device as illustrated in FIG. 6 is illustrated in FIG. 9 while a photograph of the various elements is illustrated in FIG. 10.

To produce a multi-pole tunable filter, the two-resonator system of FIG. 3 may be generalized to n successive resonators indexed i (Resi), i varying from 1 to n, n being higher than or equal to 2. By successive resonators, what is meant is resonators that follow one another in the direction z of propagation of the microwave through the system. The resonator indexed 1, Res1, is called the input resonator and the resonator indexed n, Resn, is called the output resonator. Two successive resonators i and i+1 are coupled together by an associated coupling device CDi. An example with n=4 is given below.

According to a second variant, the system according to the invention comprises a propagating guide and a resonator coupled to each other by a coupling device. For example, according to one embodiment of the n-resonator system 10, the latter comprises, in addition to the coupling devices CDi between resonators, an input coupling device CDE configured to couple an input propagating guide GPE to the input resonator Res1 and an output coupling device CDS configured to couple the output resonator Resn to an output propagating guide GPS.

Figure 11:
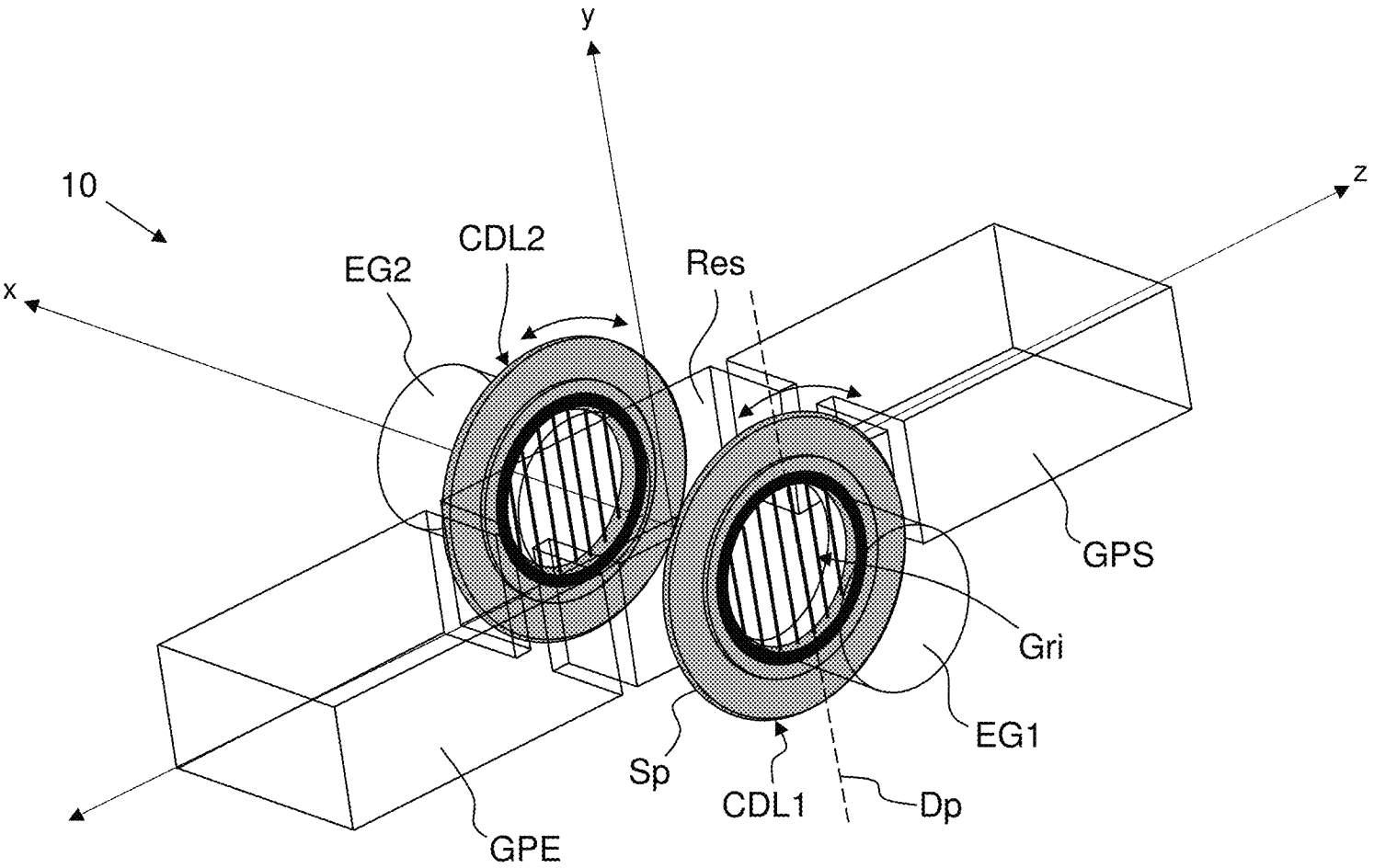
FIG. 11 illustrates a third variant in which the tunable microwave system according to the invention comprises a resonator and a first evanescent guide arranged laterally with respect to the resonator.

According to a third variant illustrated in FIG. 11, the tunable microwave system according to the invention comprises a resonator Res and a first evanescent guide EG1 arranged laterally with respect to the resonator Res with respect to a direction z of propagation of a microwave through the system. The associated coupling device arranged between the resonator Res and the first evanescent guide EG1 is called the first lateral coupling device CDL1. The coupling device is configured to produce a variation in the resonant frequency of the resonator Res as a function of the polarization direction Dp, which is measured by an angle $\beta$1. Here the direction Dp is substantially contained in the yz-plane, the angle $\beta$ being given with respect to the z-axis, i.e. $\beta$=0 for horizontal bars.

There may be no propagation or energy transported in the evanescent guide EG1, which is also called the cut-off guide. The presence of the coupling device CDL1 on a sidewall changes the boundary conditions seen by the electromagnetic field, i.e. changes the impedance seen by the electric field: the electric field no longer sees a metal wall, it sees this complex impedance, this modifying the resonant frequency of the resonator Res. Intuitively, the field may be said to "penetrate" to a greater or lesser extent into the cut-off guide before being reflected towards the cavity, which virtually "widens" the cavity and modifies the resonant frequency. In other words, the device CDL1 modifies the phase conditions of the resonator, this having an effect on the resonant frequency of the mode used.

Preferably, in order to reinforce the effect, the system 10 according to this third variant furthermore comprises a second evanescent guide EG2 arranged on the side opposite to the first evanescent guide EG1, the associated coupling device arranged between the resonator Res and the second evanescent guide EG being called the second lateral coupling device CDL2, as illustrated in FIG. 11. To simplify the modeling and obtain the maximum effect, preferably CDL1 and CDL2 are configured so as to have an identical polarization direction. With β2 measuring the polarization direction of CDL2, provision is made to lock the two rotations so that β1=β2=β.

Figure 12:
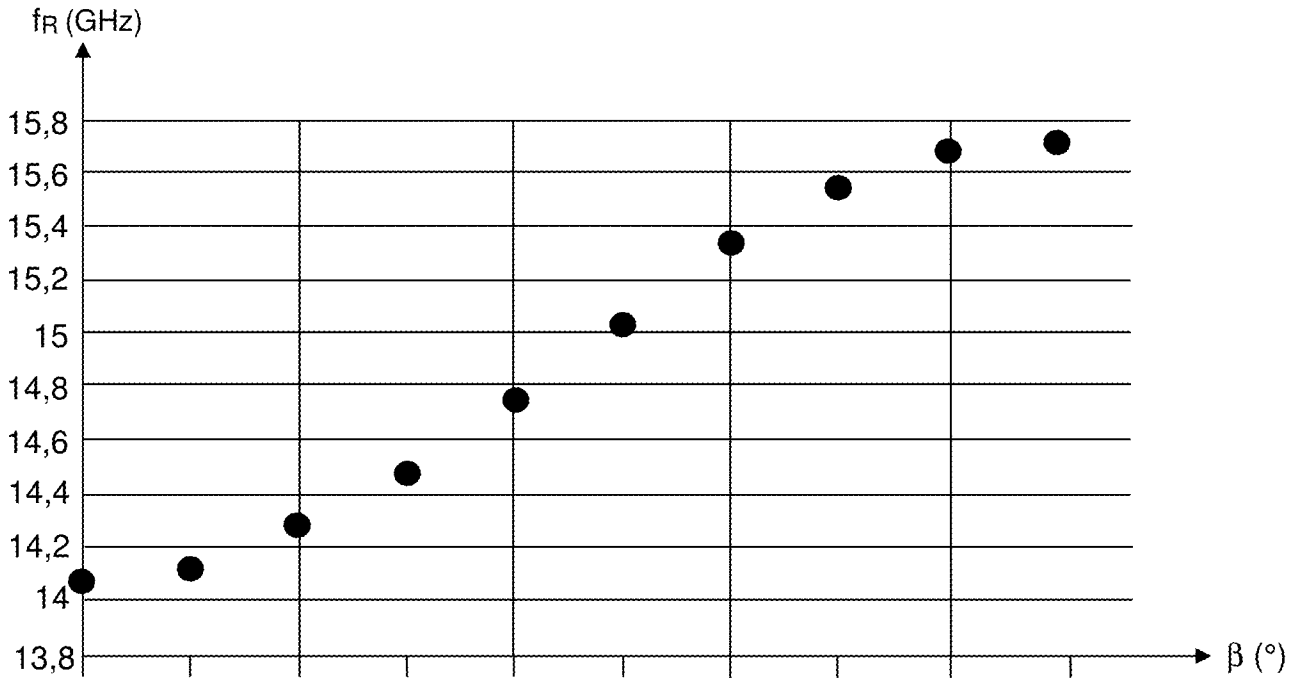
FIG. 12 illustrates an example of the variation in the resonant frequency of the resonator as a function of the value of the angle β, for a system as illustrated in FIG. 11.

FIG. 12 illustrates an example of the variation in the resonant frequency fR of the resonator Res as a function of the value of β1=β2=β, for a system as illustrated in FIG. 11 with a purely metal coupling device.

Diameter of the iris: 6.9 mm;

Dimensions of the cavity: 25×19.05×9.525 mm3;

Dimensions of the cut-off guide: radius of 6 mm and length of 12 mm.

It should be noted that the curve in FIG. 12 assumes perfect contacts, this not being the case for the "realistic" representation of FIG. 11.

It is noted that an almost linear variation in resonant frequency as a function of the angle β is obtained.

Figure 13:
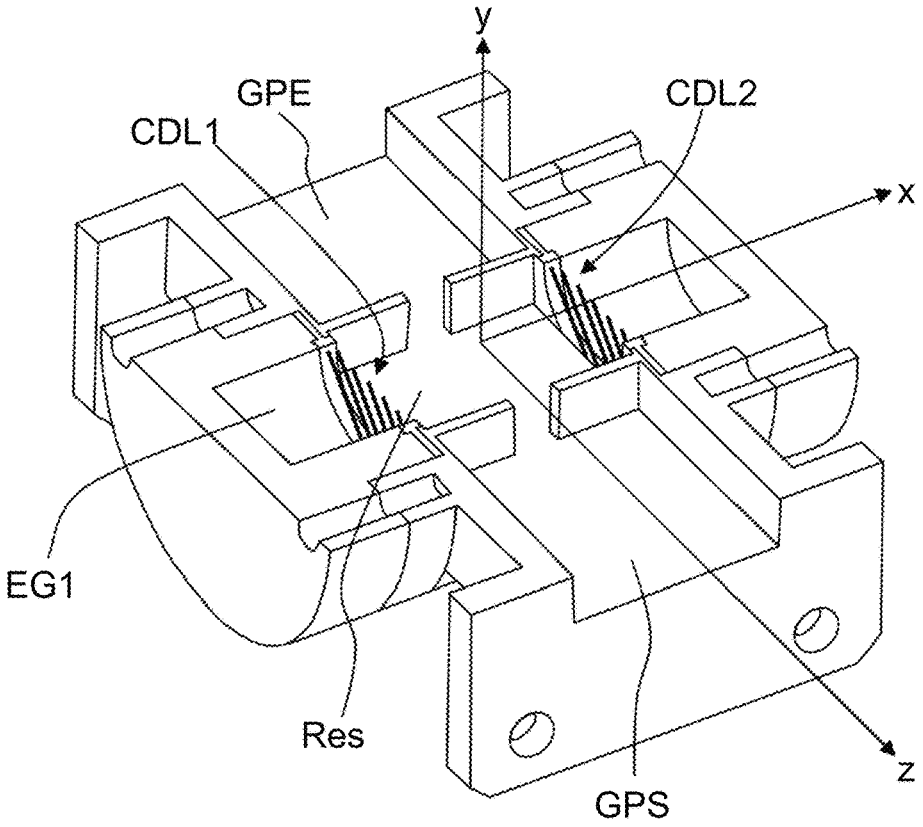
FIG. 13 illustrates a cross-sectional view of a practical embodiment of a system as illustrated in FIG. 11.
Figure 14:
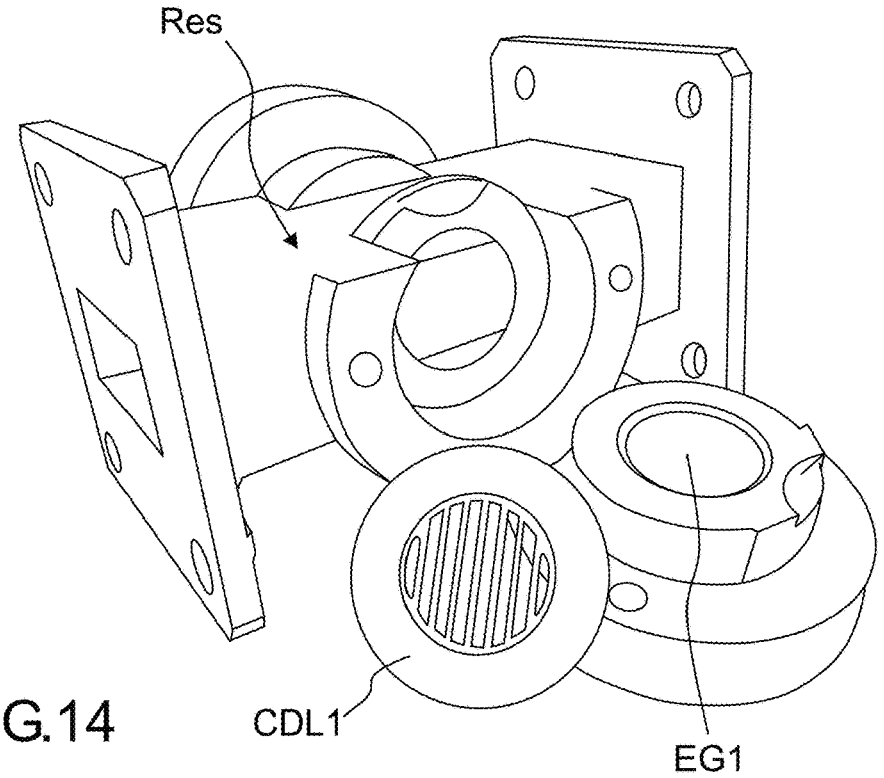
FIG. 14 is a photograph of the various constituent elements of the system of FIG. 13.

A cross-sectional view of a practical embodiment of a system as illustrated in FIG. 11 is shown in FIG. 13 while a photograph of the various elements is illustrated in FIG. 14 (here portion 35 of the holder Sp is made of dielectric material).

Figure 15A:
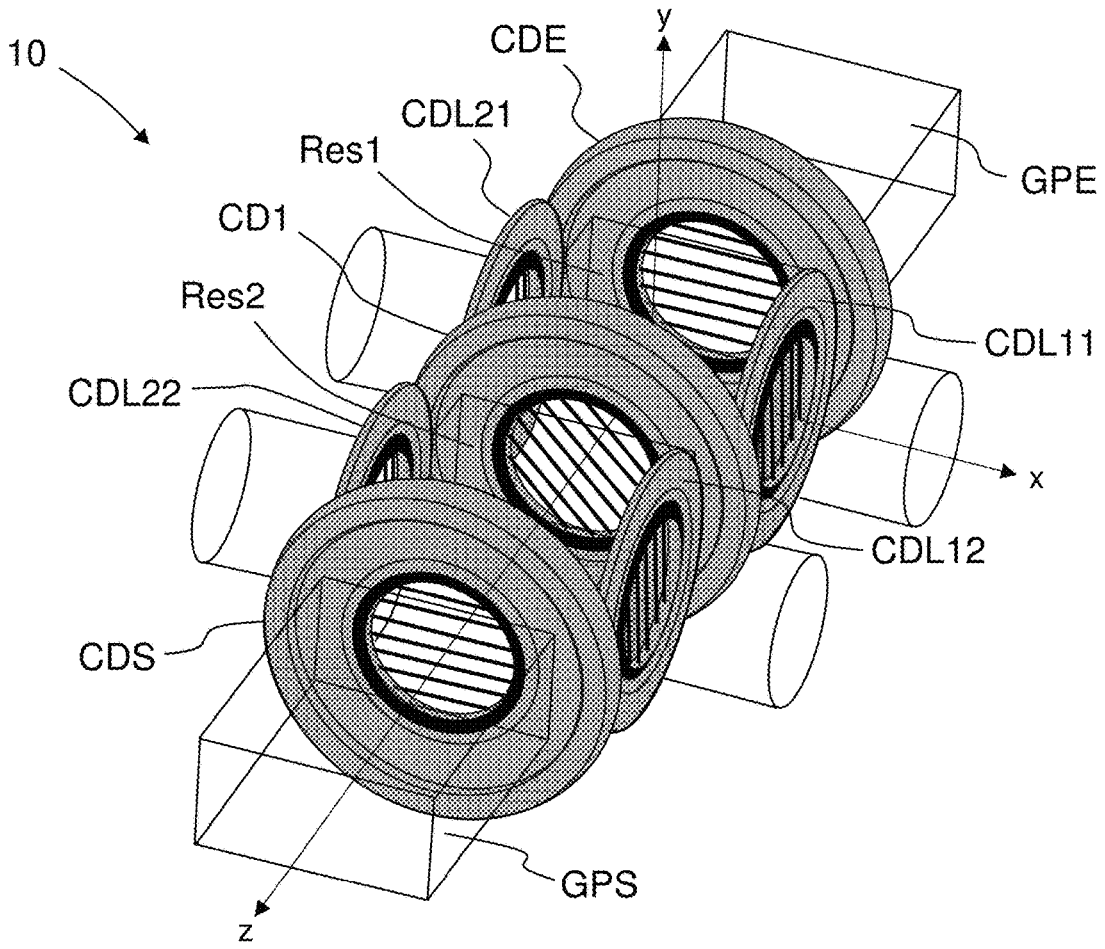
FIG. 15*a* is a perspective view and FIG. 15*b* is a view from above.
Figure 15B:
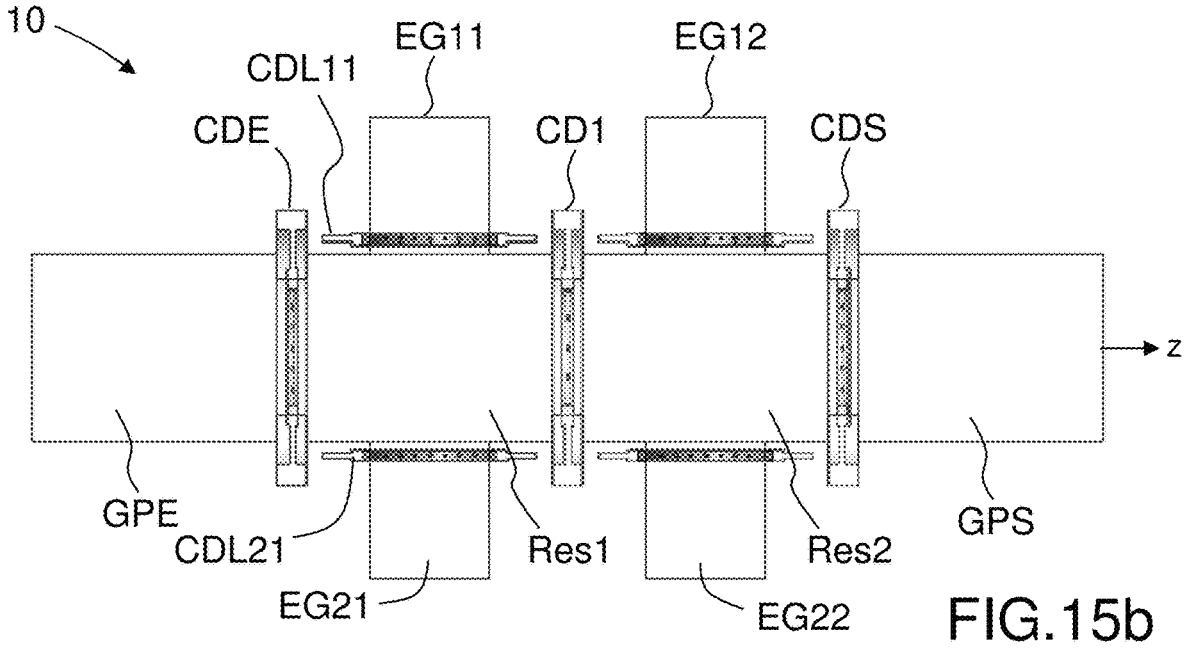

The three variants may of course be combined together, as illustrated in FIG. 15 with two resonators Res1 and Res2 (perspective view 15*a* and view from above 15b).

In this example, each resonator Res1 and Res2 comprises two lateral coupling devices, CDL11 and CDL21 for Res1 and CDL12 and CDL22 for Res2, respectively.

The combination of two or three variants may be generalized to n resonators.

Thus a system 10 according to the invention combining the first and the third variant and comprising n successive resonators Resi indexed i, i varying from 1 to n, n being higher than or equal to 2, the resonator indexed 1, Res1, being called the input resonator and the resonator indexed n, Resn, being called the output resonator. Two successive resonators i and i+1 are coupled to each other by an associated coupling device CDi, and at least one resonator i is moreover coupled to a first evanescent guide EG1*i* by a first lateral coupling device CDL1*i* and, where appropriate, to a second evanescent guide EG2*i* by a second lateral coupling device CDL2*i*. The first and, where appropriate, the second evanescent guide are arranged laterally with respect to said resonator Resi with respect to a direction z of propagation of a microwave through the system.

In combination with the second variant, the system furthermore comprises an input coupling device CDE configured to couple an input propagating guide GPE to the input resonator Res1 and an output coupling device CDS configured to couple the output resonator Resn to an output propagating guide GPS.

Figure 16:
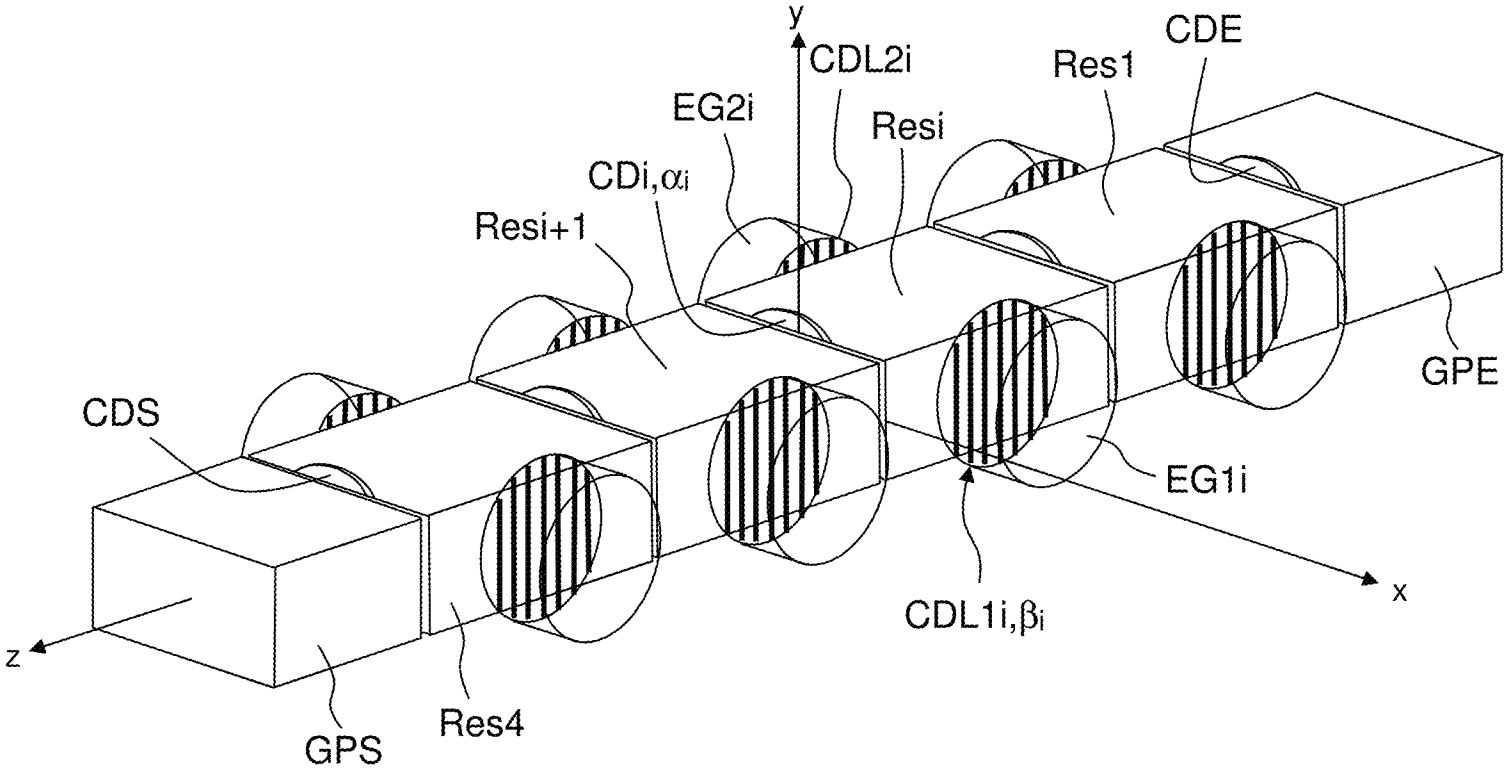
FIG. 16 illustrates a system according to the invention with 4 resonators combining the three variants, each resonator comprising two lateral coupling devices.

A system 10 with n=4 combining the three variants, each resonator Resi comprising two lateral coupling devices CDL1*i* and CDL2*i* coupling Res to EG1*i* and EG2*i*, respectively, is illustrated in FIG. 16. Only the grids are shown for the sake of improving the legibility of the drawing.

The angle α of the coupling device CDi between Resi and Resi+1 is denoted αi and the angle β of the lateral coupling devices CDL1*i* and CDL2*i* of Resi is denoted βi.

The angle of the coupling device CDE is denoted αE and the angle of the coupling device CDS is denoted as.

By adjusting the aforementioned parameters of the coupling device (size/shape/thickness of the aperture Ap, distribution/shape/material of the bars, material of the holder), the dimensions of the cavities of the resonators Resi and the angles αi and βi, an n-pole filter the central frequency and passband of which are tunable is produced.

An example of the simulated performance of a 4-pole tunable filter as illustrated in FIG. 16 is illustrated in FIG. 17, FIGS. 17*a*, 17*b* and 17*c* showing curves S12 and S11 for three sets of values of the angles α and β.

On the whole, for reasons of symmetry, the angles α are set so as to respect a front/back symmetry (αi=αNi), and the angles β are set so as to respect a left/right symmetry (identical lateral angles for a given resonator).

Figure 17A:
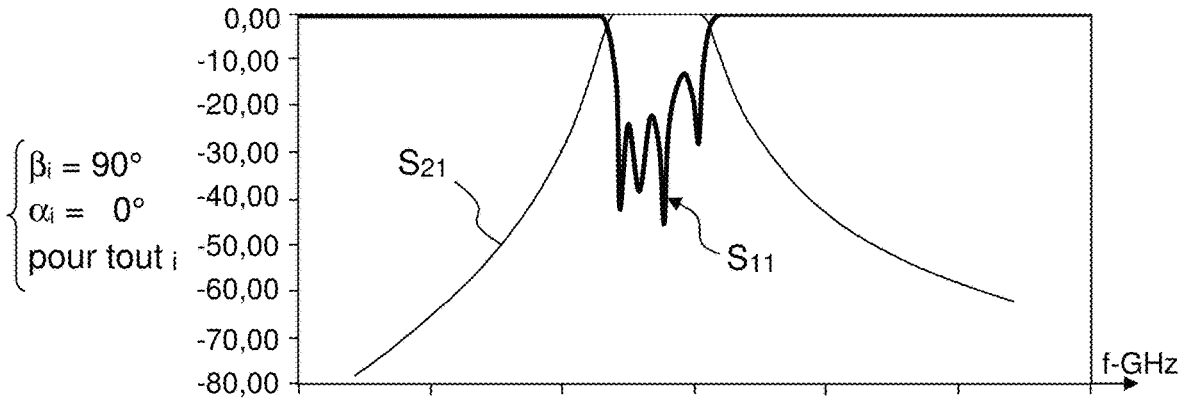
FIGS. 17*a*, 17*b* and 17*c* correspond to curves S12 and S11 for three sets of values of the angles α and β.

FIG. 17*a* illustrates a starting point with αi=0° and βi=90° for every i.

Figure 17B:
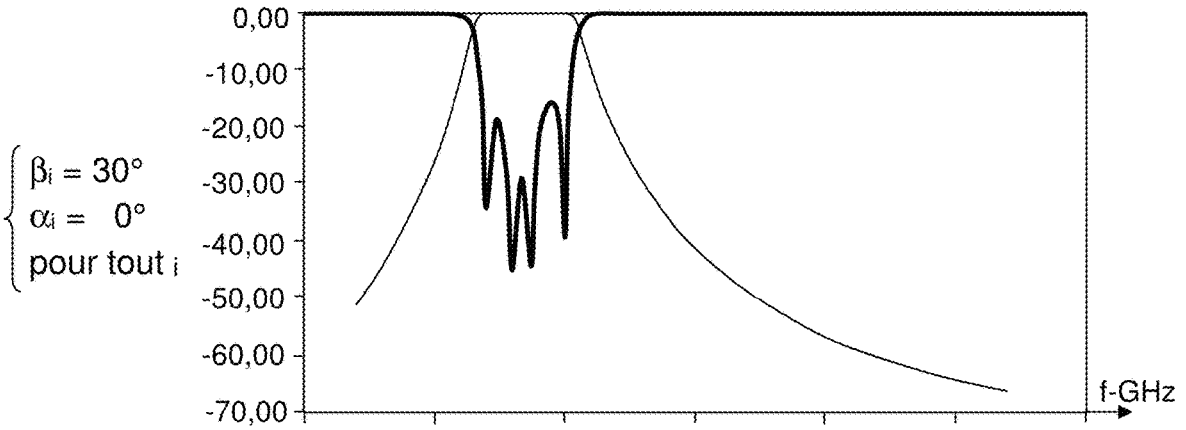

FIG. 17*b* corresponds to identical values of α and a value βi=30° for every i. It may be seen in FIG. 17*b* that the modification of the value of β at constant α modified the values of the resonant frequencies of the 4 resonators, thus shifting the central frequency. The passband remains substantially the same.

Figure 17C:
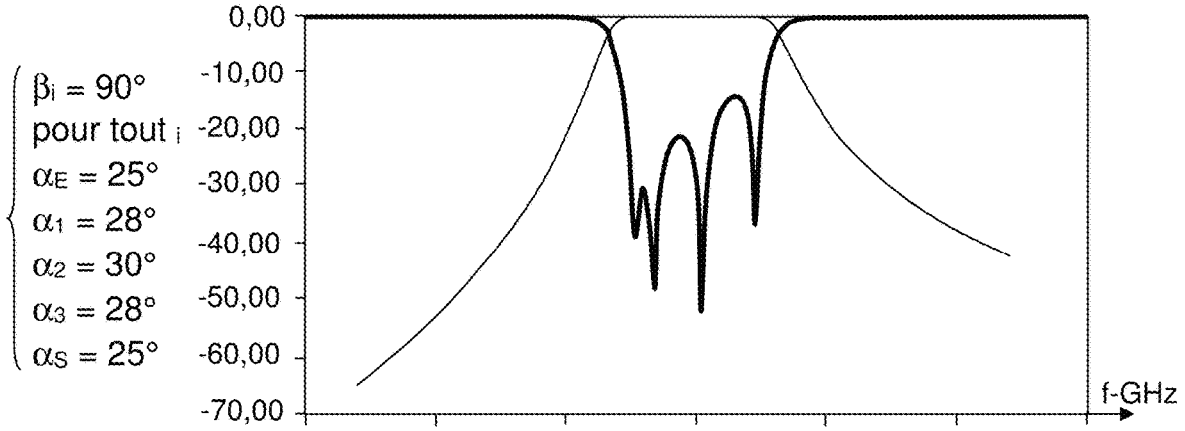

FIG. 17*c* corresponds to values of β identical to case 17*a* (βi=90° for every i) and to different values of αi: αE=25°; α2=28°; α2=30°; α3=28° and αs=25. It may be seen in FIG. 17*c* that the modification of the values of αi at constant β (compared to 17*a*) has widened the passband, while hardly changing some of the resonant frequencies.

Thus, to a first approximation, varying β allows the central frequency of the filter to be modified and varying α allows the passband to be modified. By virtue of the system 10 according to the invention, a filter the central frequency and passband of which may be reconfigured via simple rotations of the coupling devices according to the invention has been produced.

According to a fourth variant, some of the n resonators are configured so that it is furthermore possible to couple at least one resonator i to a resonator j different from i+1 (j>i), with an associated coupling device CDij arranged between the resonator i and the resonator j.

Figure 18:
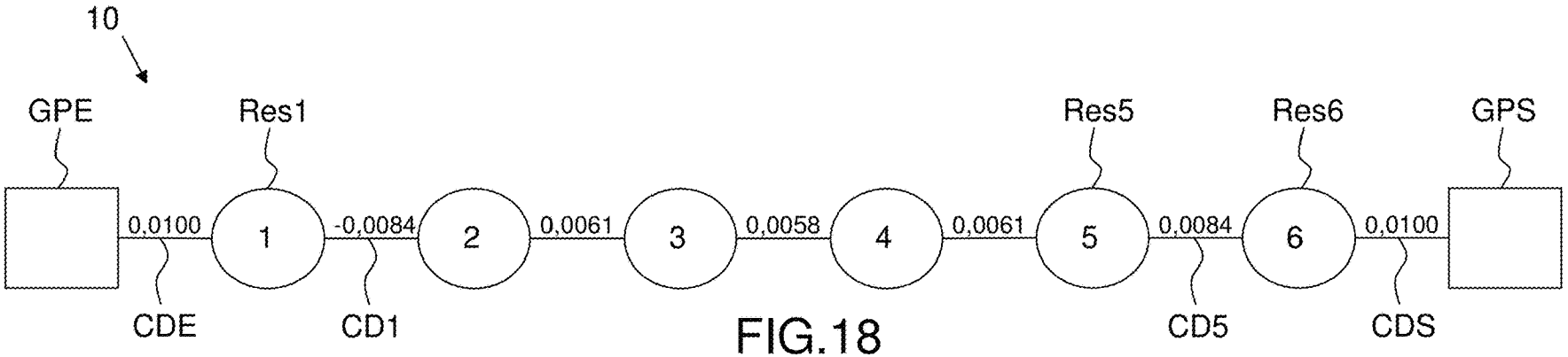
FIG. 18 illustrates a set of 6 successive resonators (symbolized by circles), the coupling devices being symbolized by lines between the circles.

FIG. 18 illustrates a set of 6 successive resonators (symbolized by circles), the coupling devices being symbolized by lines between the circles. The numerical values above the lines correspond to the value of the associated coupling coefficient Mi(αi) computed for a set value of the angle αi.

Figure 19:
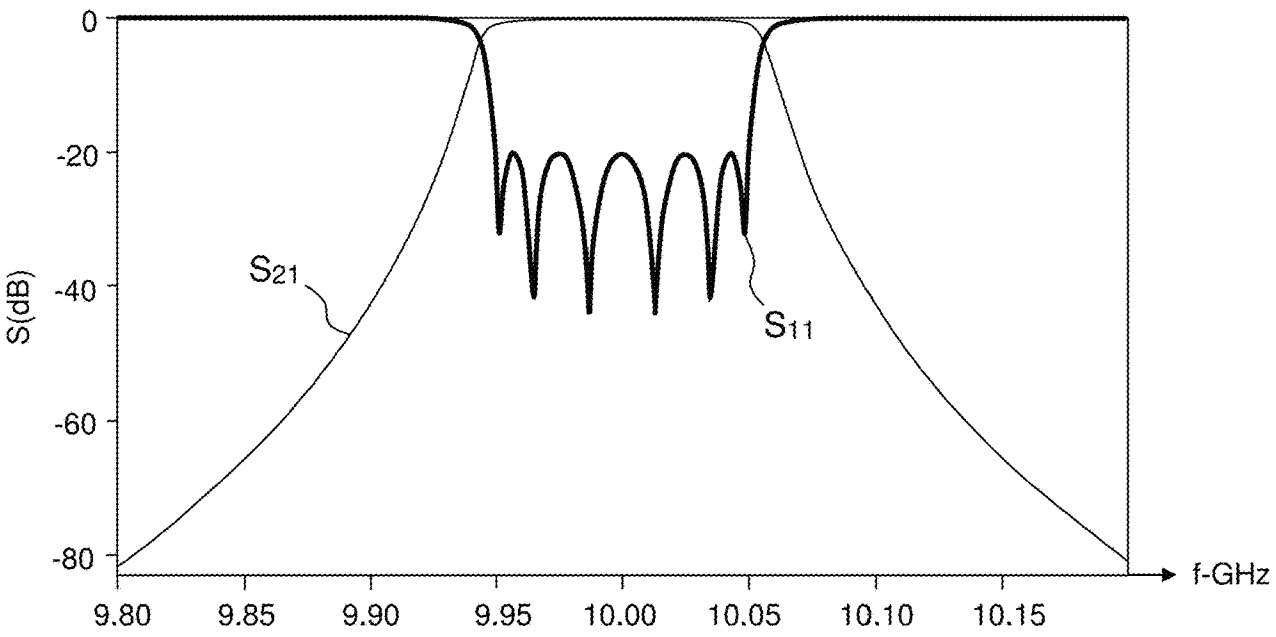
FIG. 19 illustrates the corresponding performance of the 6-pole filter.

FIG. 19 illustrates the corresponding performance of the 6-pole filter.

FIG. 20 illustrates the corresponding coupling matrix. This matrix is a 2D table collating the values of the inter-resonator coupling coefficients (e.g. Column 2—Row 1: Coupling coefficient between resonators 1 & 2), and the frequency shifts of these resonators with respect to the central frequency of the filter on the middle row (e.g.

Column 1—Row 1). This matrix allows the filtering function that it is desired to achieve, after Chebyshev synthesis for example, to be related to the physical topology of the filter (number of resonators, couplings, signs of these coupling coefficients, etc.).

The letter S is the abbreviation of "Source" and refers to the input guide and the letter L is the abbreviation of "Load" and refers to the output guide.

Figure 21:
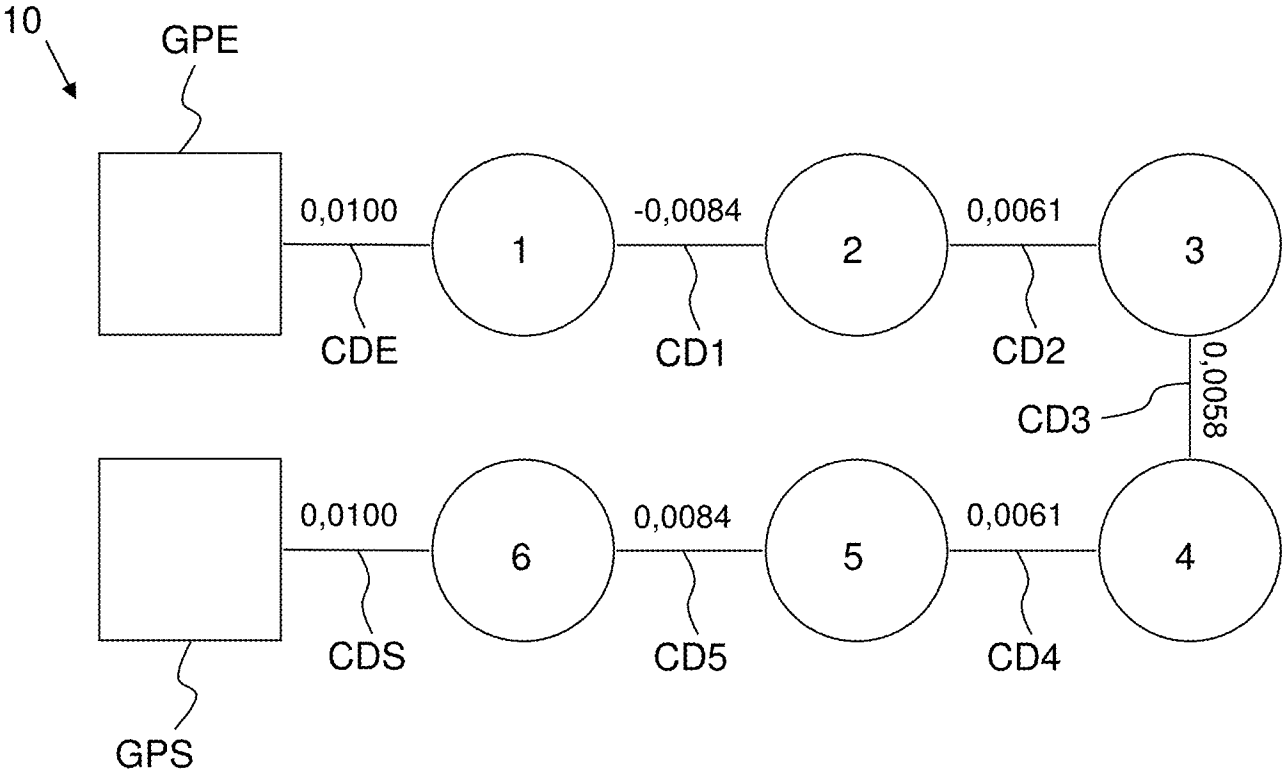
FIG. 21 illustrates the system of FIG. 18 folded.

A resonator i is coupled to a resonator j, j differing from i+1 and j>i, by folding part of the line in which the resonators are formed, as illustrated in FIG. 21. In this example, it becomes possible to couple resonators 2 and 5 and/or resonators 1 and 6.

In practice, resonators thus folded have a common wall into which a coupling device CDij according to the invention may be inserted.

Figure 22:
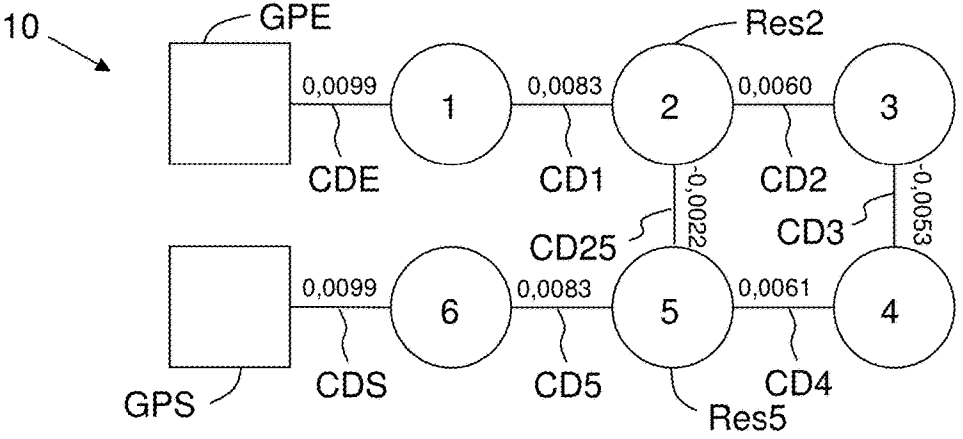
FIG. 22 illustrates a system in which two resonators that are not adjacent with respect to the direction of propagation are coupled, i.e. a resonator i=2 is coupled to a resonator j=5, j being different from i+1=3, in a folded system as shown in FIG. 21.

FIG. 22 illustrates the configuration 21 with the device CD25 between Res2 and Res5 adjusted (angle α25 set) to give the coupling coefficient M25 a set value.

According to a first embodiment, the coupling devices CDE, CDS, CDi and mainly the device CDij are configured so as to create inter-resonator interference effects (destructive interference at certain frequencies between the two defined electrical paths), allowing transmission zeros to be added to the response of the tunable filter.

Figure 23:
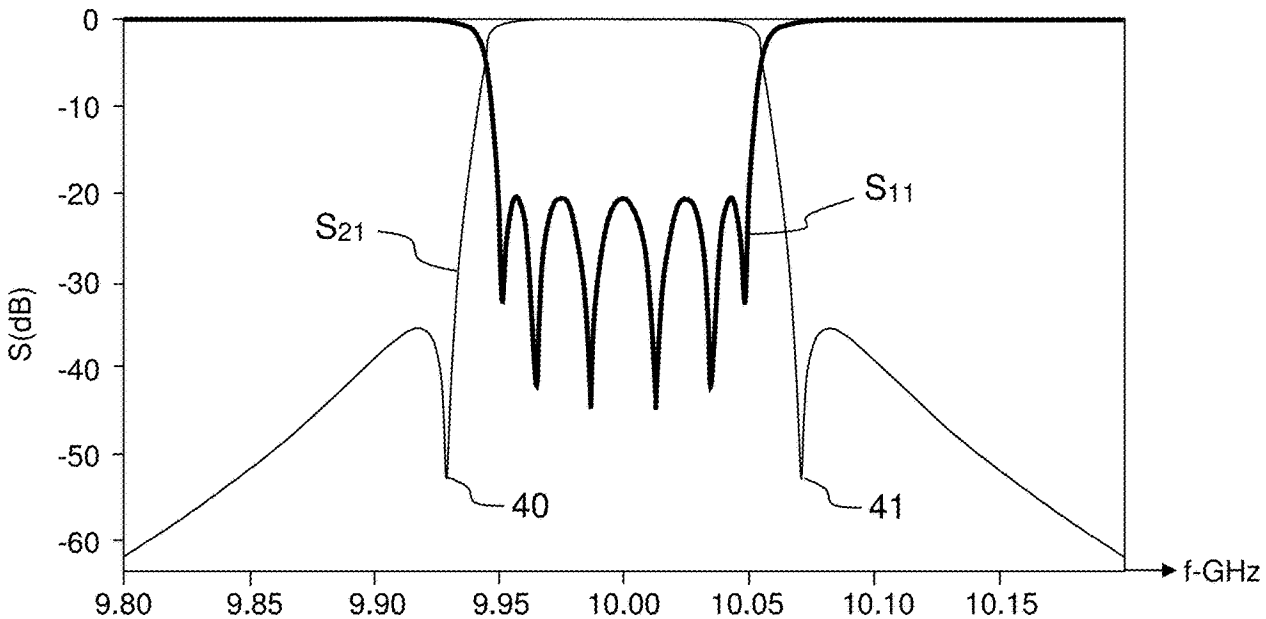
FIG. 23 illustrates the response of the filter corresponding to the system of FIG. 22.

This effect is illustrated in FIG. 23 by the transmission zeros 40 and 41, which allow the slope of the passband of the filter or selectivity to be improved.

FIG. 24 illustrates the corresponding coupling matrix. The existence of a 2-5 coupling, of fairly low value, but that it is necessary to generate to obtain the transmission zeros of the transfer function, will be noted.

To achieve correct operation, it was necessary to recompute the coupling coefficients Mi of the devices CDi slightly with respect to the configuration of FIG. 21, but the values of the Mi are easily modified by rotating the associated coupling device. Here the advantage of the flexibility of the system 10 according to the invention, in which each coupling coefficient may be individually adjusted to a preset value via a simple rotation, may be seen.

Each resonator in the folded configuration may of course have a lateral coupling device along the sidewall in contact with the exterior.

According to a fifth variant, which may be combined with the other four variants, some of the n resonators are also configured so that it is furthermore possible to couple at least one resonator i to a resonator j different from i+1, with an associated coupling device CDij arranged between the resonator i and the resonator j. Furthermore, here, the coupling device CDi between the resonator i and the resonator i+1 and the coupling device CDj−1 between the resonator j−1 and the resonator j are configured so that the coupling between the resonators i and i+1, and between the resonators j−1 and j, drops to zero for a set value of the polarization direction.

The coupling device CDi then acts as a switch, disconnecting the two resonators. No more energy is transmitted from one resonator to the other. All the resonators between i and j are thus short-circuited and hence the number of poles of the filter are decreased. By varying the coupling between the resonators by virtue of the coupling devices, a filter with a number of reconfigurable poles is therefore produced.

Figure 25:
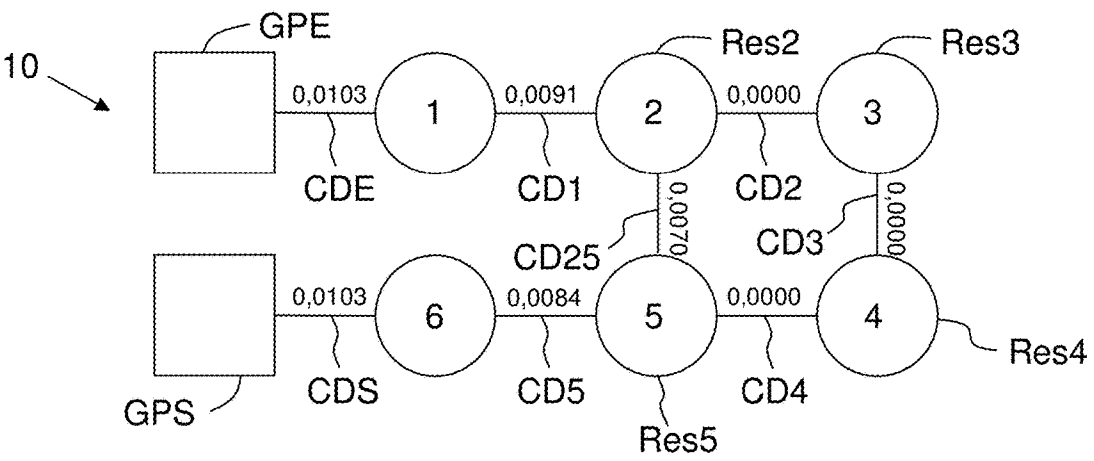
FIG. 25 shows the 6 resonators of FIG. 22, with no coupling between Res2 and Res3 and between Res4 and Res5, and between Res3 and Res4. The filter here has 4 active resonators.

An example using the 6 resonators of FIG. 22 is illustrated in FIG. 25.

The coupling between Res2 and Res3 is set to zero via CD2, the coupling between Res4 and Res5 is set to zero via CD4, and the coupling between Res3 and Res4 is also zero. The coupling between Res2 and Res5 allows energy to pass between these two resonators. In the configuration of FIG. 25, the filter 10 then comprises only 4 active resonators, i.e. 4 poles.

Figure 26:
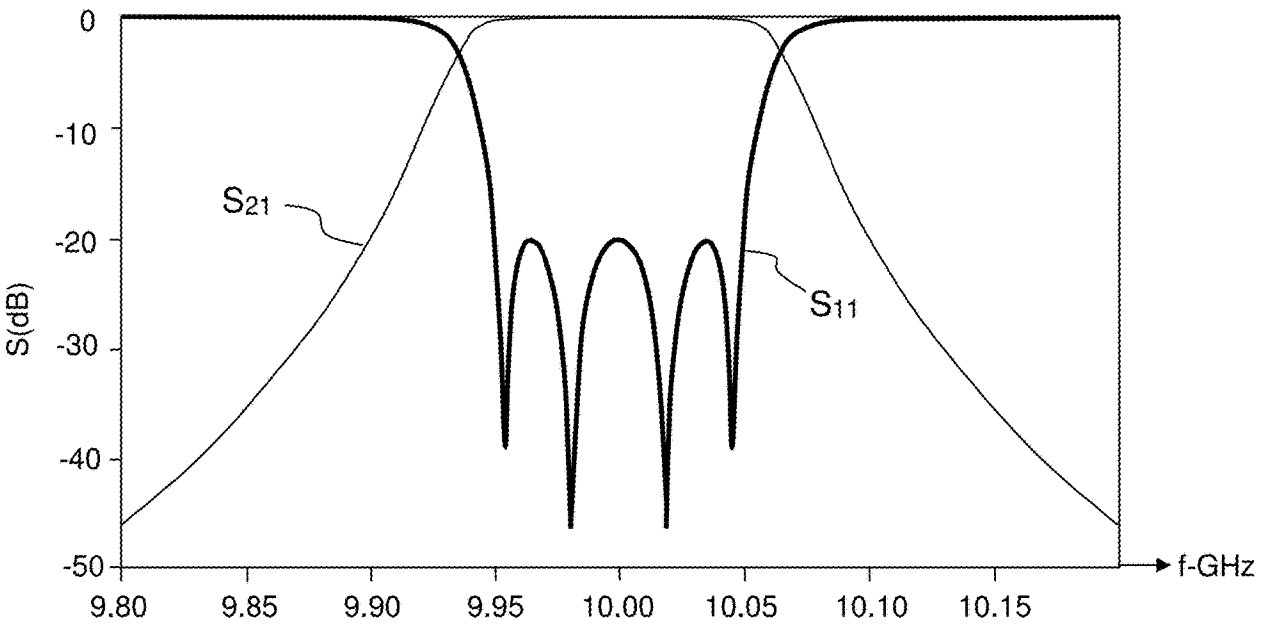
FIG. 26 illustrates the response of the filter corresponding to the system of FIG. 25.

The response of the filter corresponding to system 10 of FIG. 25 is illustrated in FIG. 26, and the corresponding coupling matrix is illustrated in FIG. 27.

Figure 28:
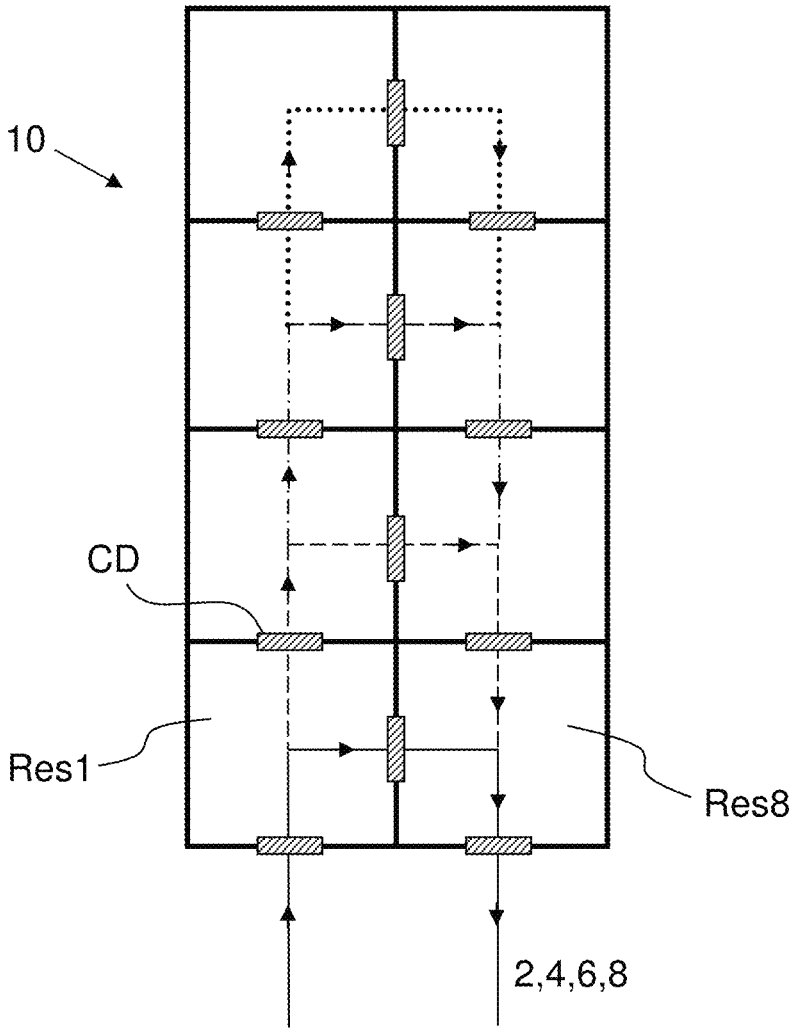
FIG. 28 illustrates a system according to the invention comprising a set of 8 resonators, which may be reconfigured into a 2-, 4-, 6- or 8-pole configuration.

A system 10 comprising a set of 8 resonators, this system being reconfigurable to have 2, 4, 6 or 8 poles, is illustrated in FIG. 28. The concept may be generalized to a matrix of n×m resonators.

Preferably, all the devices CDi arranged between i+1 and j−1 have the same property of a zero coupling coefficient at a given value of α. In FIG. 25, the coupling between Res3 and Res4 is set to zero via CD3.

This switch function is preferably achieved with a plurality of bars in the aperture Ap, a single bar not easily allowing the coupling between two resonators to be brought to zero. In addition, a periodic grid improves the switch effect. In this case, a linearly polarized mode is preferably used in the cavities.

By virtue of the coupling devices arranged according to the various variants, a filter the central frequency, passband, and number of poles of which may be tuned by varying the angle α of each coupling device has been produced.

According to another variant, the two elements are two contiguous propagating guides GP1 and GP2.

Figure 29:
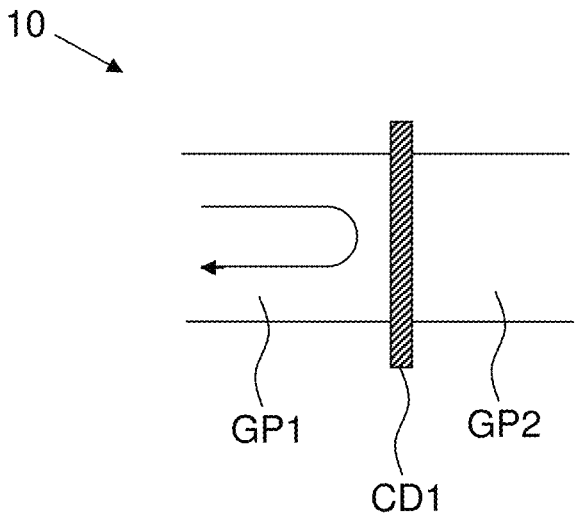
FIG. 29 illustrates an embodiment in which the two elements are in-line propagating guides that are coupled to each other by an associated coupling device configured so that the coupling between the propagating guides drops to zero for a set value of the polarization direction.

According to one embodiment illustrated in FIG. 29, they are coupled to each other by an associated coupling device CD1 configured so that the coupling between said propagating guides drops to zero for a set value of the polarization direction. Thus the switch either allows the microwave propagating in the guide GP1 to pass fully into GP2, or reflects this wave (zero coupling).

Figure 30:
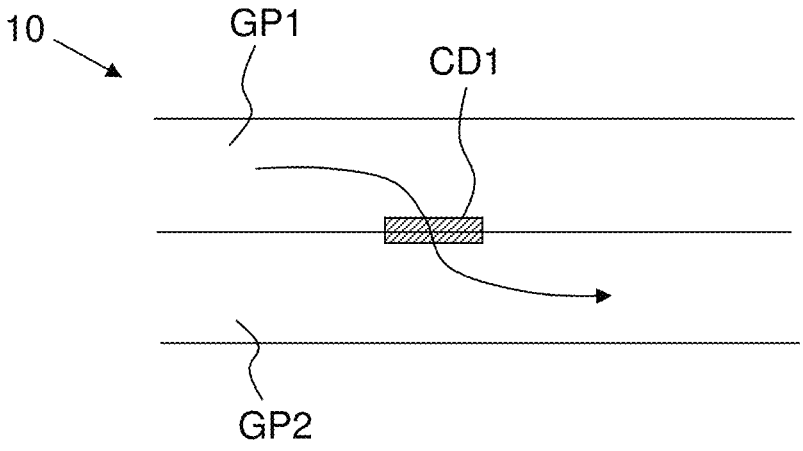
FIG. 30 illustrates another embodiment in which the two propagating guides are parallel to each other and the associated coupling device is arranged in a wall common to the two guides.

According to another embodiment illustrated, in FIG. 30, the two propagating guides are parallel to each other and the associated coupling device CD1 is arranged in a wall common to the two guides, and is configured to transfer a microwave propagating in one of the guides to the other, the transfer being dependent on the value of the polarization direction. For a coupling coefficient of zero, the wave remains in GP1. When the coupling is activated, an adjustable amount or the entirety of the wave passes into GP2. A coupler function is thus achieved.

According to another embodiment, the propagating guides intersect.

The invention claimed is:

1. A tunable microwave system comprising at least two elements, each element being chosen from a propagating guide (GPE, GPS, GP1, GP2), an evanescent guide (EG1*i*, EG2*i*), a resonator (Res1, Res2, Resi, Res), and at least one coupling device (CD) arranged between the two elements and configured to couple the two elements to each other, said coupling device (CD, CDi, CDE, CDS, CDL1*i*, CDL2*i*, CDij) comprising a holder (Sp) having an aperture (Ap) and comprising at least one elongate element the shape of which is elongate in a direction called the polarization direction (Dp) contained in a plane (P) of the aperture, said elongate element being securely fastened to the perimeter of the aperture at at least one end, said coupling device being configured to be rotatable about an axis substantially perpendicular to said plane of the aperture so as to modify a value of the polarization direction (Dp) and so that the coupling between the two elements is dependent on said value of the polarization direction.

2. The system as claimed in claim 1, wherein the coupling device (CD) comprises a plurality of elongate elements parallel to one another.

3. The system as claimed in claim 2, wherein the elongate elements form a grid (Gri) in the aperture (Ap).

4. The system as claimed in claim 1, wherein the one or more elongate elements are wire, bar or strip shaped.

5. The system as claimed in claim 1, wherein the aperture (Ap) is circular or oval in shape.

6. The system as claimed in claim 1, wherein the one or more elongate elements are made of a metallized dielectric material or metal material, and are electrically connected to one another by a metal contact arranged on the perimeter of the aperture.

7. The system as claimed in claim 1, wherein the holder (Sp) takes the form of a circular disk configured to be rotated manually or using a micro stepper motor.

8. The system as claimed in claim 1, wherein at least one portion of the holder (Sp) is made of dielectric material.

9. The system as claimed in claim 1, comprising n successive resonators (Resi) indexed i, i varying from 1 to n, n being higher than or equal to 2, the resonator indexed 1 (Res1) being called the input resonator and the resonator indexed n (Resn) being called the output resonator, wherein two successive resonators i and i+1 are coupled to each other by an associated coupling device (CDi), the system performing a tunable n-pole filter function.

10. The system as claimed in claim 9, furthermore comprising an input coupling device (CDE) configured to couple an input propagating guide (GPE) to the input resonator (Res1) and an output coupling device (CDS) configured to couple the output resonator (Resn) to an output propagating guide (GPS).

11. The system as claimed in claim 1, comprising a resonator (Res) and a first evanescent guide (EG1) arranged laterally with respect to said resonator (Res) with respect to a direction (z) of propagation of a microwave through the system, the associated coupling device arranged between the resonator and the first evanescent guide being called the first lateral coupling device (CDL1), and being configured to produce a variation in a resonant frequency of said resonator as a function of the polarization direction (Dp).

12. The system as claimed in claim 11, furthermore comprising a second evanescent guide (EG2) arranged on the opposite side to the first evanescent guide, the associated coupling device arranged between the resonator and the second evanescent guide being called the second lateral coupling device (CDL2), the first and second lateral coupling devices being configured to have an identical polarization direction.

13. The system as claimed in claim 1, comprising n resonators (Resi) indexed i, i varying from 1 to n, n being higher than or equal to 2, the resonator indexed 1 (Res1) being called the input resonator and the resonator indexed n (Resn) being called the output resonator, wherein two successive resonators i and i+1 are coupled to each other by an associated coupling device (CDi), and wherein at least one resonator i (Resi) is moreover coupled to a first evanescent guide (EG1*i*) by a first lateral coupling device (CDL1*i*) and, where appropriate, to a second evanescent guide (EG2*i*) by a second lateral coupling device (CDL2*i*), the first and, where appropriate, the second evanescent guide being arranged laterally with respect to said resonator (Resi) with respect to a direction (z) of propagation of a microwave through the system.

14. The system as claimed in claim 13, furthermore comprising an input coupling device (CDE) configured to couple an input propagating guide (GPE) to the input resonator (Res1) and an output coupling device (CDS) configured to couple the output resonator (Resn) to an output propagating guide (GPS).

15. The system as claimed in claim 13, wherein the n resonators are configured so that a resonator i is furthermore coupled to a resonator j different from i+1 with an associated coupling device (CDij) arranged between the resonator i and the resonator j.

16. The system as claimed in claim 15, wherein the coupling device (CDij) arranged between the resonator i and the resonator j is configured to create inter-resonator interference effects that allow transmission zeros to be added to the transmission of the tunable filter.

17. The system as claimed in claim 15, wherein the coupling device between the resonator i and the resonator i+1 (CDi) and the coupling device between the resonator j−1 and the resonator j (CDj−1) are configured so that the coupling between said resonators drops each to zero for a set value of the polarization direction, so that the filter has a number of reconfigurable poles.

18. The system as claimed in claim 1, comprising two contiguous propagating guides coupled to each other by an associated coupling device configured so that the coupling between said propagating guides drops to zero for a set value of the polarization direction.

19. The system as claimed in claim 1, comprising two propagating guides parallel to each other, wherein the associated coupling device is arranged in a wall common to the two guides and is configured to achieve a transfer of a microwave propagating through one of the guides propagating to the other guide, said transfer being dependent on the value of the polarization direction.

* * * * *